US006845809B1

(12) United States Patent
Norville et al.

(10) Patent No.: US 6,845,809 B1
(45) Date of Patent: Jan. 25, 2005

(54) APPARATUS FOR AND METHOD OF PRODUCING ON-DEMAND SEMI-SOLID MATERIAL FOR CASTINGS

(75) Inventors: Samuel M. D. Norville, Jackson, TN (US); Patrick J. Lombard, Jackson, TN (US); Jian Lu, Jackson, TN (US); Shaupoh Wang, Jackson, TN (US)

(73) Assignee: AEMP Corporation, Jackson, TN (US)

( * ) Notice: Subject to any disclaimer, the term of this patent is extended or adjusted under 35 U.S.C. 154(b) by 0 days.

(21) Appl. No.: 09/585,061

(22) Filed: Jun. 1, 2000

Related U.S. Application Data

(63) Continuation-in-part of application No. 09/250,824, filed on Feb. 17, 1999, now abandoned.

(51) Int. Cl.[7] ..... B22D 27/02
(52) U.S. Cl. ..... 164/113; 164/900; 164/499
(58) Field of Search ..... 164/113, 900, 164/499

(56) References Cited

U.S. PATENT DOCUMENTS

| | | | | |
|---|---|---|---|---|
| 972,429 | A | 10/1910 | Baird | 266/241 |
| 1,506,281 | A | 8/1924 | Baily | 266/280 |
| 1,776,355 | A | 9/1930 | Eppensteiner | 266/280 |
| 3,472,502 | A | 10/1969 | Schott | 266/27 |
| 3,791,015 | A | 2/1974 | Lucenti | 29/401 |

(List continued on next page.)

FOREIGN PATENT DOCUMENTS

| | | | |
|---|---|---|---|
| EP | 0 701 002 A1 | 3/1996 | C22C/1/00 |
| EP | 0710 515 A1 | 5/1996 | B21K/1/00 |
| EP | 0 745 694 A1 | 12/1996 | C22C/1/00 |
| EP | 0 841 406 A1 | 5/1998 | C22C/1/00 |
| EP | 0 903 193 A1 | 3/1999 | B22D/17/30 |

(List continued on next page.)

OTHER PUBLICATIONS

U.S. patent application Ser. No. 09/250,824, Norville et al., filed Feb. 17, 1999.

(List continued on next page.)

*Primary Examiner*—Tom Dunn
*Assistant Examiner*—Kevin P. Kerns
(74) *Attorney, Agent, or Firm*—Woodard Emhardt Moriarty McNett & Henry LLP

(57) ABSTRACT

A method of producing on-demand, semi-solid material for a casting process includes the steps of first heating a metal alloy until it reaches a molten state and maintaining that molten state within a desired temperature range. The next step is to ladle out a portion of the molten alloy and transfer it into a processing vessel. In one arrangement the vessel is configured with its own cooling arrangement so as to begin the solidification process for the molten alloy. In another embodiment, a thermal jacket is used to facilitate the cooling of the vessel and accordingly the cooling of the molten alloy. The next step is to apply an electromagnetic field to the molten alloy in order to create a stirring action which results in a desired flow pattern of the molten alloy within the vessel. The electromagnetic stirring begins as soon as the molten alloy is placed in the vessel and continues while the cooling continues in order to create a slurry billet of the desired metallurgical composition. The final step is to discharge the slurry billet from the vessel directly into a shot sleeve of a casting machine. The apparatus related to the described method includes a vessel which is constructed and arranged for receipt of the molten alloy. A robotic arm is provided in one embodiment for moving the vessel into a stator and then from the stator to the discharge location. In another embodiment, pneumatic cylinders are used in cooperation with structural linkages to effect movement of the vessel first into the stator and then from the stator to the discharge location. Suitable cooling arrangements for the vessel include cooling lines within the vessel, the passage of cooling air between the stator and the vessel, and the use of a thermal jacket.

30 Claims, 15 Drawing Sheets

U.S. PATENT DOCUMENTS

| | | | | | |
|---|---|---|---|---|---|
| 3,840,364 | A | | 10/1974 | Flemings et al. | 75/63 |
| 3,842,895 | A | | 10/1974 | Mehrabian et al. | 164/49 |
| 3,882,923 | A | | 5/1975 | Alberny et al. | |
| 3,902,544 | A | | 9/1975 | Flemings et al. | 164/71 |
| 3,948,650 | A | | 4/1976 | Flemings et al. | 75/135 |
| 3,951,651 | A | | 4/1976 | Mehrabian et al. | 75/135 |
| 3,981,351 | A | | 9/1976 | Dompass | 164/283 |
| 3,995,678 | A | | 12/1976 | Zavaras et al. | |
| 4,088,295 | A | | 5/1978 | Medovar et al. | 249/79 |
| 4,089,680 | A | | 5/1978 | Flemings et al. | 75/129 |
| 4,108,643 | A | | 8/1978 | Flemings et al. | 75/135 |
| 4,125,364 | A | | 11/1978 | Stephens | 432/145 |
| 4,174,214 | A | | 11/1979 | Bennett et al. | 75/168 R |
| 4,229,210 | A | | 10/1980 | Winter et al. | 75/10 |
| 4,321,958 | A | | 3/1982 | Delassus | 164/504 |
| 4,345,637 | A | | 8/1982 | Flemings et al. | 164/113 |
| 4,415,374 | A | | 11/1983 | Young et al. | 148/2 |
| 4,434,837 | A | | 3/1984 | Winter et al. | 164/468 |
| 4,450,893 | A | | 5/1984 | Winter et al. | 164/468 |
| 4,457,354 | A | | 7/1984 | Dantzig et al. | 164/468 |
| 4,457,355 | A | | 7/1984 | Winter et al. | 164/468 |
| 4,465,118 | A | | 8/1984 | Dantzig et al. | 164/452 |
| 4,482,012 | A | | 11/1984 | Young et al. | 165/146 |
| 4,494,461 | A | | 1/1985 | Pryor et al. | 102/464 |
| 4,523,624 | A | | 6/1985 | Dantzig et al. | 164/454 |
| 4,524,820 | A | | 6/1985 | Gullotti et al. | 164/476 |
| 4,530,404 | A | | 7/1985 | Vives | 164/467 |
| 4,555,272 | A | | 11/1985 | Ashok et al. | 148/3 |
| 4,565,241 | A | | 1/1986 | Young | 164/499 |
| 4,569,218 | A | | 2/1986 | Baker et al. | 72/342 |
| 4,607,682 | A | | 8/1986 | Dantzig et al. | 164/418 |
| 4,614,225 | A | | 9/1986 | Ernst et al. | 164/504 |
| RE32,529 | E | | 10/1987 | Vives | 164/467 |
| 4,709,746 | A | | 12/1987 | Young et al. | 164/485 |
| 4,712,413 | A | | 12/1987 | Koch | 72/361 |
| 4,729,422 | A | | 3/1988 | Ernst et al. | 164/468 |
| 4,774,992 | A | | 10/1988 | George | 164/122.1 |
| 4,838,988 | A | | 6/1989 | Lang et al. | 156/624 |
| 4,877,079 | A | | 10/1989 | Long et al. | 164/468 |
| 5,098,487 | A | * | 3/1992 | Brauer et al. | 148/432 |
| 5,135,564 | A | | 8/1992 | Fujikawa et al. | 75/10.14 |
| 5,219,018 | A | | 6/1993 | Meyer | 164/468 |
| 5,247,988 | A | | 9/1993 | Kurzinski | 164/485 |
| 5,332,200 | A | | 7/1994 | Gorin et al. | 266/280 |
| 5,425,048 | A | | 6/1995 | Heine et al. | 373/151 |
| 5,501,266 | A | | 3/1996 | Wang et al. | 164/113 |
| 5,529,391 | A | | 6/1996 | Kindman et al. | 366/145 |
| 5,549,732 | A | | 8/1996 | Dube et al. | 75/331 |
| 5,585,067 | A | | 12/1996 | Leroy et al. | 420/554 |
| 5,630,466 | A | | 5/1997 | Garat et al. | 164/457 |
| 5,701,942 | A | | 12/1997 | Adachi et al. | 164/71.1 |
| 5,899,567 | A | | 5/1999 | Morris, Jr. | 366/274 |
| 5,900,080 | A | | 5/1999 | Baldi et al. | 148/550 |
| 5,925,199 | A | | 7/1999 | Shiina et al. | 148/538 |
| 6,003,590 | A | | 12/1999 | Pavlicevic et al. | 164/468 |
| 6,021,842 | A | | 2/2000 | Bulhoff et al. | 164/504 |
| 6,065,526 | A | * | 5/2000 | Kono | 164/113 |
| 6,165,411 | A | | 12/2000 | Adachi et al. | 266/135 |

FOREIGN PATENT DOCUMENTS

| | | | | |
|---|---|---|---|---|
| JP | 61-67555 | | 4/1986 | |
| JP | 1-192446 | * | 8/1989 | 164/900 |
| JP | 6-28939 | | 2/1994 | |
| WO | WO95/19237 | | 7/1995 | B22D/18/08 |
| WO | WO98/23403 | | 6/1998 | B22D/17/30 |
| WO | WO 98/30346 | | 7/1998 | B22D/11/04 |
| WO | WO99/50007 | | 10/1999 | B22D/17/30 |
| WO | WO00/05015 | | 2/2000 | B22D/17/08 |

OTHER PUBLICATIONS

"Semisolid Metal Process Eliminates Preformed Billets", by Samuel D. Norville, *Die Casting Management*, Mar. 1998, pp. 31–33.

Vives, C., "Elaboration of Metal Matrix Composites from Thixotropic Alloy Slurries using a New Magnetohydrodynamic Caster", *Metallurgical Transactions B*, vol., 24B, No. 3, Jun. 1993, pp. 493–510, Metallurgical Society of AIME, New York, U.S.

* cited by examiner

APPARATUS FOR AND METHOD OF PRODUCING ON-DEMAND SEMI-SOLID MATERIAL FOR CASTINGS

REFERENCE TO RELATED APPLICATION

The present application is a continuation-in-part patent application of patent application entitled PROCESS FOR SEMI-SOLID CASTING OF METALS, U.S. Ser. No. 09/250,824, filed Feb. 17, 1999, abandoned.

BACKGROUND OF THE INVENTION

The present invention relates in general to an apparatus which is constructed and arranged for producing an "on-demand" semi-solid material for use in a casting process. Included as part of the overall apparatus are various stations which have the requisite components and structural arrangements which are to be used as part of the process. The method of producing the on-demand semi-solid material, using the disclosed apparatus, is included as part of the present invention.

More specifically, the present invention incorporates electromagnetic stirring and various temperature control and cooling control techniques and apparata to facilitate the production of the semi-solid material within a comparatively short cycle time. Also included are structural arrangements and techniques to discharge the semi-solid material directly into a casting machine shot sleeve. As used herein, the concept of "on-demand" means that the semi-solid material goes directly to the casting step from the vessel where the material is produced. The semi-solid material is typically referred to as a "slurry" and the slug which is produced as a "single shot" is also referred to as a billet. These terms have been combined in this disclosure to represent a volume of slurry which corresponds to the desired single shot billet.

Semi-solid forming of light metals for net-shape and near-net shape manufacturing can produce high strength, low porosity components with the economic cost advantages of die casting. However, the semi-solid molding (SSM) process is a capital intensive proposition tied to the use of metal purchased as pre-processed billets or slugs.

Parts made with the SSM process are known for high quality and strength. SSM parts compare favorably with those made by squeeze casting, a variation of die casting that uses large gate areas and a slow cavity fill. Porosity is prevented by slow, non-turbulent metal velocities (gate velocities between 30 and 100 in./sec.) and by applying extreme pressure to the part during solidification. Both squeeze casting and SSM processes produce uniformly dense parts that are heat-treatable.

SSM offers the process economics of die casting and the mechanical properties that approach those of forgings. In addition, SSM capitalizes on the non-dendritic microstructure of the metal to produce parts of high quality and strength. SSM can cast thinner walls than squeeze casting due to the globular alpha grain structure, and it has been used successfully with both aluminum and magnesium alloys. SSM parts are weldable and pressure tight without the need for impregnation under extreme pressure that characterizes the squeeze-cast process.

The SSM process has been shown to hold tighter dimensional capabilities than any other aluminum molding process. That has intensified demand for SSM components due to the potential for significant cost savings, reduction of machining, and quicker cycle times for higher production rates. Besides high strength and minimal porosity, SSM parts exhibit less part-to-die shrinkage than die cast parts and very little warpage. It produces castings that are closer to the desired net shape, which reduces and can even eliminate secondary machining operations. Surface finishes on the castings are often better than the iron and steel parts they replace.

The SSM process requires higher final mold pressure (15,000 to 30,000 psi) than conventional die casting (7,000 to 12,000 psi), but modern die casting equipment provides the flexibility needed to produce SSM parts efficiently and economically. Real-time, closed-loop hydraulic circuits incorporated into today's die casting machines can automatically maintain the correct fill velocities of the SSM material alloy. Closed-loop process control systems monitor metal temperature and time, voltage feedback from electrical stator and other data to provide a very robust and precisely controlled operation that can maximize productivity of high quality parts and ensure reproducibility.

As described, it is well known that semi-solid metal slurry can be used to produce products with high strength and low porosity at net shape or near net shape. However, the viscosity of semi-solid metal is very sensitive to the slurry's temperature or the corresponding solid fraction. In order to obtain good fluidity at high solid fraction, the primary solid phase of the semisolid metal should be nearly spherical.

In general, semi-solid processing can be divided into two categories; thixocasting and rheocasting. In thixocasting, the microstructure of the solidifying alloy is modified from dendritic to discrete degenerated dendrite before the alloy is cast into solid feedstock, which will then be re-melted to a semi-solid state and cast into a mold to make the desired part. In rheocasting, liquid metal is cooled to a semi-solid state while its microstructure is modified. The slurry is then formed or cast into a mold to produce the desired part or parts.

The major barrier in rheocasting is the difficulty to generate sufficient slurry within preferred temperature range in a short cycle time. Although the cost of thixocasting is higher due to the additional casting and remelting steps, the implementation of thixocasting in industrial production has far exceeded rheocasting because semi-solid feedstock can be cast in large quantities in separate operations which can be remote in time and space from the reheating and forming steps.

In a semi-solid casting process, generally, a slurry is formed during solidification consisting of dendritic solid particles whose form is preserved. Initially, dendritic particles nucleate and grow as equiaxed dendrites within the molten alloy in the early stages of slurry or semi-solid formation. With the appropriate cooling rate and stirring, the dendritic particle branches grow larger and the dendrite arms have time to coarsen so that the primary and secondary dendrite arm spacing increases. During this growth stage in the presence of stirring, the dendrite arms come into contact and become fragmented to form degenerate dendritic particles. At the holding temperature, the particles continue to coarsen and become more rounded and approach an ideal spherical shape. The extent of rounding is controlled by the holding time selected for the process. With stirring, the point of "coherency" (the dendrites become a tangled structure) is not reached. The semi-solid material comprised of fragmented, degenerate dendrite particles continues to deform at low shear forces. The present invention incorporates apparata and methods in a novel and unobvious manner which utilize the metallurgical behavior of the alloy to create a suitable slurry within a comparatively short cycle time.

When the desired fraction solid and particle size and shape have been attained, the semi-solid material is ready to be formed by injecting into a die-mold or some other forming process. Primary aluminum (alpha) particle size is controlled in the process by limiting the slurry creation process to temperatures above the point at which solid alpha begins to form and alpha coarsening begins.

It is known that the dendritic structure of the primary solid of a semi-solid alloy can be modified to become nearly spherical by introducing the following perturbation in the liquid alloy near liquidus temperature or semi-solid alloy:

1) Stirring: mechanical stirring or electromagnetic stirring;
2) Agitation: low frequency vibration, high-frequency wave, electric shock, or electromagnetic wave;
3) Equiaxed Nucleation: rapid under-cooling, grain refiner;
4) Oswald Ripening and Coarsening: holding alloy in semi-solid temperature for a long time.

While the methods in (2)–(4) have been proven effective in modifying the microstructure of semi-solid alloy, they have the common limitation of not being efficient in the processing of a high volume of alloy with a short preparation time due to the following characteristics or requirements of semi-solid metals:

High dampening effect in vibration.

Small penetration depth for electromagnetic waves.

High latent heat against rapid under-cooling.

Additional cost and recycling problem to add grain refiners.

Natural ripening takes a long time, precluding a short cycle time.

While most of the prior art developments have been focused on the microstructure and rheology of semi-solid alloy, temperature control has been found by the present inventors to be one of the most critical parameters for reliable and efficient semi-solid processing with a comparatively short cycle time. As the apparent viscosity of semi-solid metal increases exponentially with the solid fraction, a small temperature difference in the alloy with 40% or higher solid fraction results in significant changes in its fluidity. In fact, the greatest barrier in using methods (2)–(4), as listed above, to produce semi-solid metal is the lack of stirring. Without stirring, it is very difficult and likely impossible to make alloy slurry with the required uniform temperature and microstructure, especially when the there is a requirement for a high volume of the alloy. Without stirring, the only way to heat/cool semi-solid metal without creating a large temperature difference is to use a slow heating/cooling process. Such a process often requires that multiple billets of feedstock be processed simultaneously under a pre-programmed furnace and conveyor system, which is expensive, hard to maintain, and difficult to control.

While using high-speed mechanical stirring within an annular thin gap can generate high shear rate sufficient to break up the dendrites in a semi-solid metal mixture, the thin gap becomes a limit to the process's volumetric throughput. The combination of high temperature, high corrosion (e.g. of molten aluminum alloy) and high wearing of semi-solid slurry also makes it very difficult to design, to select the proper materials and to maintain the stirring mechanism.

Prior references disclose the process of forming a semi-solid slurry by reheating a solid billet, formed by thixocasting, or directly from the melt using mechanical or electromagnetic stirring. The known methods for producing semi-solid alloy slurries include mechanical stirring and inductive electromagnetic stirring. The processes for forming a slurry with the desired structure are controlled, in part, by the interactive influences of the shear and solidification rates.

In the early 1980's, an electromagnetic stirring process was developed to cast semi-solid feedstock with discrete degenerate dendrites. The feedstock is cut to proper size and then remelt to semi-solid state before being injected into mold cavity. Although this magneto hydrodynamic (MHD) casting process is capable of generating high volume of semi-solid feedstock with adequate discrete degenerate dendrites, the material handling cost to cast a billet and to remelt it back to a semi-solid composition reduces the competitiveness of this semi-solid process compared to other casting processes, e.g. gravity casting, low-pressure die-casting or high-pressure die-casting. Most of all, the complexity of billet heating equipment, the slow billet heating process and the difficulties in billet temperature control have been the major technical barriers in semi-solid forming of this type.

The billet reheating process provides a slurry or semi-solid material for the production of semi-solid formed (SSF) products. While this process has been used extensively, there is a limited range of castable alloys. Further, a high fraction of solids (0.7 to 0.8) is required to provide for the mechanical strength required in processing with this form of feedstock. Cost has been another major limitation of this approach due to the required processes of billet casting, handling, and reheating as compared to the direct application of a molten metal feedstock in the competitive die and squeeze casting processes.

In the mechanical stirring process to form a slurry or semi-solid material, the attack on the rotor by reactive metals results in corrosion products that contaminate the solidifying metal. Furthermore, the annulus formed between the outer edge of the rotor blades and the inner vessel wall within the mixing vessel results in a low shear zone while shear band formation may occur in the transition zone between the high and low shear rate zones. There have been a number of electromagnetic stirring methods described and used in preparing slurry for thixocasting billets for the SSF process, but little mention has been made of an application for rheocasting.

The rheocasting, i.e., the production by stirring of a liquid metal to form semi-solid slurry that would immediately be shaped, has not been industrialized so far. It is clear that rheocasting should overcome most of limitations of thixocasting. However, in order to become an industrial production technology, i.e., producing stable, deliverable semi-solid slurry on-line (i.e., on-demand) rheocasting must overcome the following practical challenges: cooling rate control, microstructure control, uniformity of temperature and microstructure, the large volume and size of slurry, short cycle time control and the handling of different types of alloys, as well as the means and method of transferring the slurry to a vessel and directly from the vessel to the casting shot sleeve.

One of the ways to overcome above challenges, according to the present invention, is to apply electromagnetic stirring of the liquid metal when it is solidified into semi-solid ranges. Such stirring enhances the heat transfer between the liquid metal and its container to control the metal temperature and cooling rate, and generates the high shear rate inside of the liquid metal to modify the microstructure with discrete degenerate dendrites. It increases the uniformity of metal temperature and microstructure by means of the molten metal mixture. With a careful design of the stirring mechanism and method, the stirring drives and controls a large volume and size of semi-solid slurry, depending on the application requirements. The stirring helps to shorten the cycle time by controlling the cooling rate, and this is applicable to all type of alloys, i.e., casting alloys, wrought alloys, MMC, etc.

While propeller type, mechanical stirring has been used in the context of making a semi-solid slurry, there are certain problems or limitations. For example, the high temperature and the corrosive and high wearing characteristics of semi-solid slurry, makes it very difficult to design a reliable slurry apparatus with mechanical stirring. However, the most critical limitation of using mechanical stirring in rheocasting is that its small throughput cannot meet the requirements production capacity. It is also known that semi-solid metal with discrete degenerated dendrite can also be made by introducing low frequency mechanical vibration, high-frequency ultra-sonic waves, or electric-magnetic agitation with a solenoid coil. While these processes may work for smaller samples at slower cycle time, they are not effective in making larger billet because of the limitation in penetration depth. Another type of process is solenoidal induction agitation, because of its limited magnetic field penetration depth and unnecessary heat generation, it has many technological problems to implement for productivity. Vigorous electromagnetic stirring is the most widely used industrial process permits the production of a large volume of slurry. Importantly, this is applicable to any high-temperature alloys. The present invention, which focuses on the apparata and methods of delivering a semi-solid slurry on demand, employs the use of multiple-pole stators.

Two main variants of vigorous electromagnetic stirring exist, one is termed "rotary " stator stirring due to the rotary flow pattern of the alloy within the vessel. The other is termed "linear" stator stirring due to the up and down flow loop of the alloy within the vessel. With rotational or rotary stator stirring, the molten metal is moving in a quasi-isothermal plane, therefore, the degeneration of dendrites is achieved by dominant mechanical shear. U.S. Pat. No. 4,434,837, issued Mar. 6, 1984 to Winter et al., describes an electromagnetic stirring apparatus for the continuous making of thixotropic metal slurries in which a stator having a single two pole arrangement generates a non-zero rotating magnetic field which moves transversely of a longitudinal axis. The moving magnetic field provides a magnetic stirring force directed tangentially to the metal container, which produces a shear rate of at least 50 $sec^{-1}$ to break down the dendrites. With linear stator stirring, the slurries within the mesh zone are re-circulated to the higher temperature zone and remelted, therefore, the thermal processes play a more important role in breaking down the dendrites. U.S. Pat. No. 5,219,018, issued Jun. 15, 1993 to Meyer, describes a method of producing thixotropic metallic products by continuous casting with polyphase current electromagnetic agitation. This method achieves the conversion of the dendrites into nodules by causing a refusion of the surface of these dendrites by a continuous transfer of the cold zone where they form towards a hotter zone.

A part formed according to this invention will typically have equivalent or superior mechanical properties, particularly elongation, as compared to castings formed by a fully liquid-to-solid transformation within the mold, the latter castings having a dendritic structure characteristic of other casting processes.

SUMMARY OF THE INVENTION

A method of producing on-demand, semi-solid material for a casting process according to one embodiment of the present invention comprises the steps of first heating a metal alloy until it reaches a molten state, transferring an amount of the molten alloy into a vessel, cooling the molten alloy in the vessel, applying an electromagnetic field to the molten alloy in the vessel for creating a flow pattern of the molten alloy while the cooling continues in order to create a slurry billet and then transferring the slurry billet directly into a shot sleeve of a die casting machine. Another embodiment of the present invention discloses an apparatus for producing on-demand, semi-solid material for a casting process. This apparatus comprises a vessel which is constructed and arranged for receipt of an amount of molten alloy, means for moving the vessel between a forming station and a discharge location, a stator which is constructed and arranged for effecting electromagnetic stirring of the molten alloy, the vessel being positioned within the stator and cooling means for lowering the temperature of the amount of molten alloy which is placed in the vessel while the electromagnetic stirring is performed so as to produce a slurry billet within a comparatively short cycle time which is less than three minutes.

One object of the present invention is to provide an improved method of producing on-demand, semi-solid material for a casting process.

Another object of the present invention is to provide an improved apparatus for producing on-demand, semi-solid material for a casting process.

Related objects and advantages of the present invention will be apparent from the following description.

DESCRIPTION OF THE PREFERRED EMBODIMENT

Figure 1:
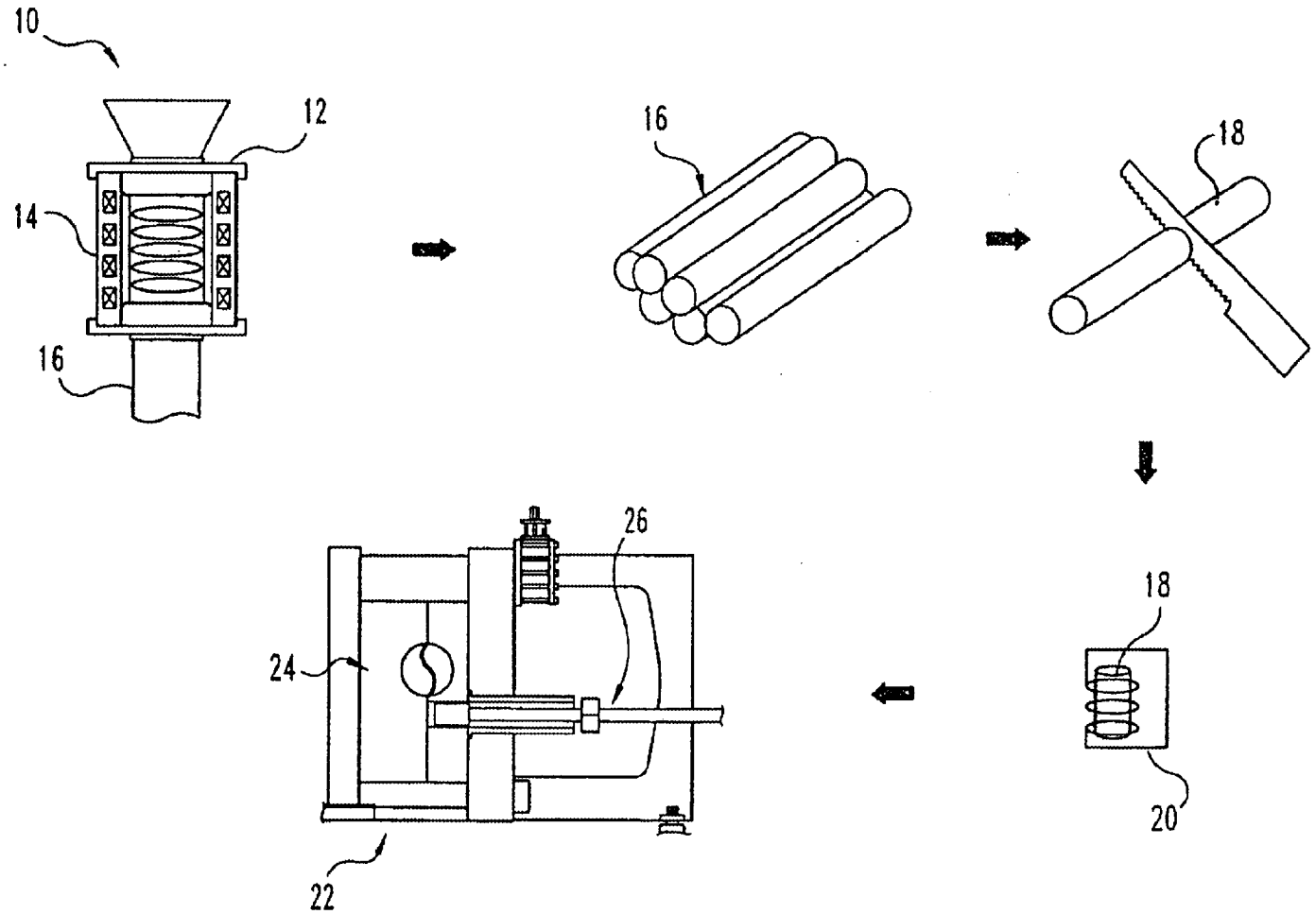
Fig. 1 (PRIOR ART)
FIG. 1 is a diagrammatic process flow diagram detailing a prior art process for forming non-dendritic material.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a prior art process for forming non-dendritic material wherein liquid molten metal alloy 10 is fed into a mold 12 that is surrounded by an electrical stator 14 that applies a rotating electromagnetic field to the metal alloy as it solidifies in mold 12. This causes rotational movement of the alloy 10 as it begins to solidify in the mold, and in this particular example the direction of rotation is about the vertical axis. This stirring causes the microstructure of the alloy to change from dendritic to globular and, as it exits the mold, it is cooled by means of a water jacket to thereby completely solidify the alloy into a billet 16. The raw billet 16 is then cut into a plurality of slugs 18 in order to obtain the desired unit of material.

The electromagnetic stirring causes a type of shearing of the alloy in its semi-solid state so that the microstructure of the primary solid phase would change from typical dendrites into rounded particles suspended in the liquid eutectic phase. It is well known that the theological properties of the suspension system will change with the thermal and shearing history due to the microstructure evolution. As a result, the measured apparent viscosity of semi-solid metal exhibits thixotropic and shear thinning characteristics. In the case of the FIG. 1 arrangement, before the solidified billets 16 or slugs 18 can be processed, they need to be transported to a processing station where they are reheated, for example by an induction heater 20, back to a semi-solid form, placed in the die casting machine 22, and injected into the mold 24 by means of injection mechanism 26. The reheated, semi-solid form has a primary phase which remains in the form of solid particles and the eutectic phase melts. Since the viscosity of the semi-solid metal is relatively higher than that of liquid metal, its flow into the die cavity (i.e., mold) is typically laminar, which is preferred in order to avoid trapped air or the associated oxide in the part. Because of its high solid fraction, semi-solid metal has small shrinkage when it solidifies in the die. As a result, parts made with semi-solid metal have higher strength, better leak tightness, and improved near net shape, when compared with liquid-metal casting processes. Due to the temperature sensitivity of semi-solid alloy and the importance of its viscosity, one of the major challenges of any suitable process is to be able to control the temperature of the alloy and the rate of heat transfer. Another significant concern or disadvantage of the semi-solid process, as illustrated in FIG. 1, is the price premium paid in order to cast and then to remelt billets with degenerated dendritic structure.

Figure 2:
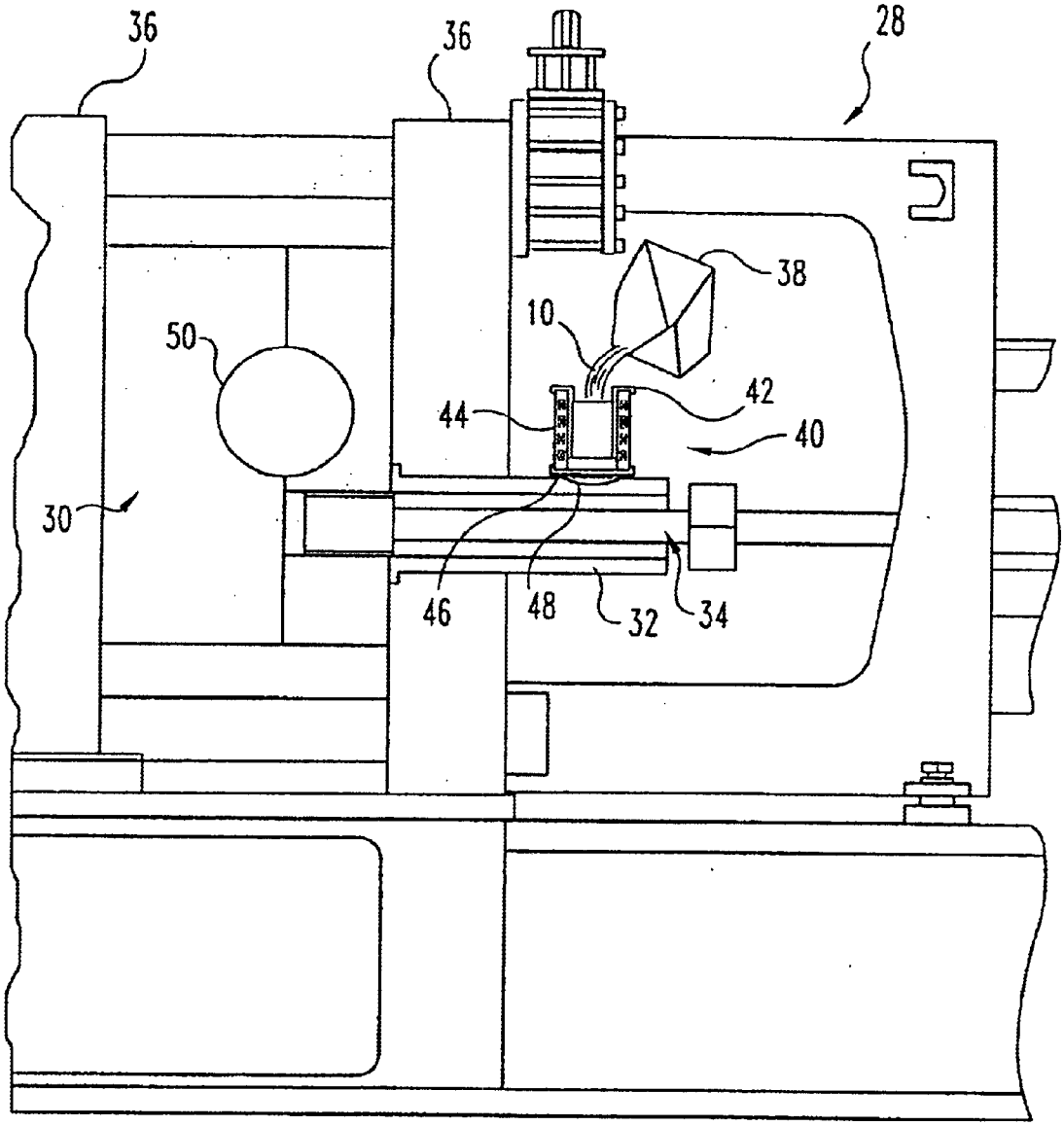
Fig. 2 (PRIOR ART)
FIG. 2 is a diagrammatic, side elevational view of a die casting machine constructed and arranged for casting of a semi-solid material.

Referring now to FIG. 2, there is illustrated a die casting machine 28, comprising a mold 30, shot sleeve 32, injection ram 34, and clamps 36. Molten aluminum alloy is poured from a vessel 38 into an electromagnetic stirring mechanism 40 comprising a vessel 42 surrounded by an electrical stator 44. Stator 44 is constructed and arranged to create a magnetomotive force to induce a flow pattern in the molten alloy. This flow pattern typically includes rotation of the alloy about a vertical axis. The lower end of transfer 42 is closed by means of a removable plug or gate 46. Vessel 42 is positioned directly over the pour hole 48 of shot sleeve 32 such that the exit opening of vessel 42 registers with pour hole 48.

The vigorousness of the stirring of the metal within vessel 42 and the rate of cooling is carefully controlled so that proper grain structure is achieved as the metal solidifies into a semi-solid state. Since cooling of the alloy occurs while the alloy is being stirred, the cooling rate and shear rate become critical parameters. Once the desired degenerated, dendritic structure is achieved with the desired molding temperatures, the semi-molten metal is discharged through pour hole 48 into shot sleeve 32, and ram 34 is advanced to inject the semi-solid metal into the cavity 50 of mold 30. The residence time (and cooling rate) of the semi-solid metal within vessel 42 is correlated to the cycle time of die casting machine 28 so that the cycle time can be minimized. Additionally, the cooling rate control governs the amount of metal which will be prepared, as required for the mold size. For example, if the cycle time for injecting a certain size shot is forty seconds and the desired residence time of the molten material within vessel 42 prior to injection is thirty seconds, then molten metal 10 will be poured into vessel 42 thirty seconds in advance of the time for the next shot.

If the residence time in the vessel 42 necessary to achieve the proper grain size and structure is longer than the cycle time of the die casting machine, two or more vessels 42 can be utilized and sequentially discharged into the die casting machine. The concern which might call for a plurality of vessels relates, in part, to the amount of semi-solid metal and the amount of latent heat which needs to be removed, all within the press cycle time. If the amount of semi-solid metal is so high that there is not sufficient residence time to remove the necessary heat, then using a plurality of vessels is one solution.

Figure 2A:
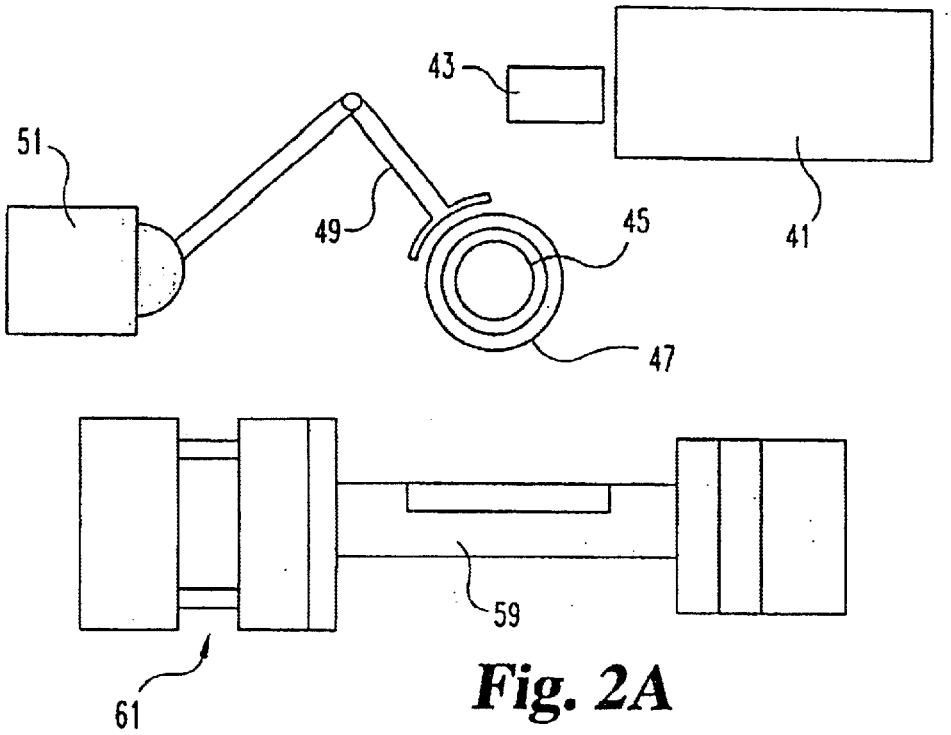
FIG. 2A is a diagrammatic, top plan view of the components and the layout of those components for the casting of a semi-solid material according to the present invention.

In FIG. 2A, an alternative embodiment to what is disclosed in FIG. 2 is illustrated. In FIG. 2A, a furnace 41 provides the supply of molten metal alloy for use in a die casting process. A ladle 43 is used to transfer a volume of molten alloy to vessel 45 which is located within stator 47. A robotic arm 49 with a range of motion, controlled by robotic control 51, is used to move the ladle to the vessel. The stator 47 is configured so as to create a magnetomotive force to produce a flow pattern in the molten alloy. In this regard one contemplated option (see FIG. 2B) is to provide a closing cap 53 for the vessel in order to prevent splash out or spitting of the alloy while being stirred. The use of a closing cap also permits the use of an inert gas to be captured above the slurry so as to reduce the risk of contamination due to the formation of oxide impurities or the like. A thermocouple 55 is inserted through the cap so as to be placed into the molten alloy in order to monitor and measure the molten alloy temperature within vessel 45. The closing cap 53 is preferably fabricated out of a non-metallic material, such as a refractory material or out of a metallic material, such as stainless steel, with corrosion-resistant coating.

The heat of the molten metal alloy is removed by means of natural air convection, or by forced air convection, or by the use of thermal jacket which is clamped around the vessel. The choice as to which cooling arrangement may be desired depends in part on the alloy, the design of the vessel, and the volume of molten alloy which is to be processed. As before with the FIG. 2 arrangement, the cooling rate and shear rate of the alloy within vessel 45 is carefully controlled in order to obtain a degenerated dendritic structure, the preferred structure for the die casting of parts according to the present invention, and to reach the molding temperature within a relatively short cycle time. At this stage in the process, the semi-solid alloy is transferred into the shot sleeve 59 of die casting machine 61. The robotic arm 49 is designed for use in this transferring step. By controlling the cooling rate of the alloy within vessel 45, it is possible to ensure that the required amount of semi-solid alloy will be prepared.

Figure 2B:
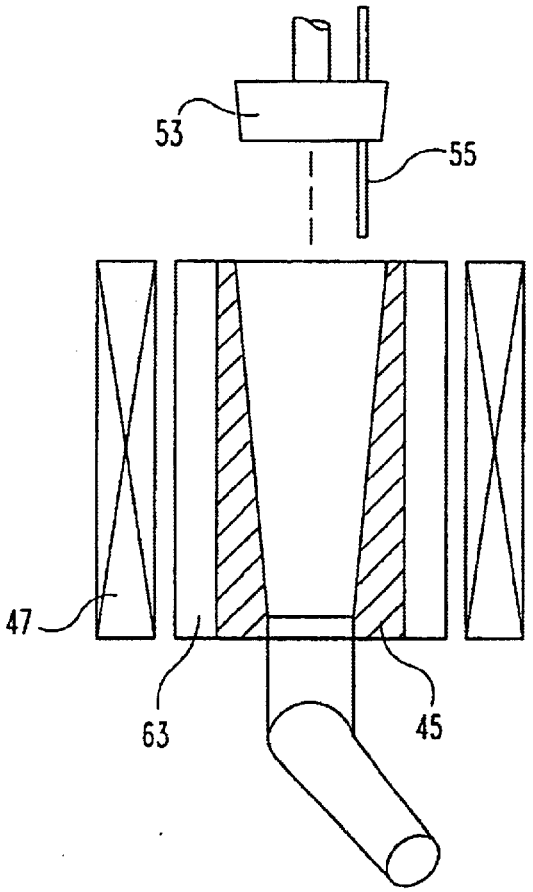
FIG. 2B is a diagrammatic, front elevational view of a stator, vessel, and cap comprising part of the FIG. 2A components according to the present invention.
Figure 3:
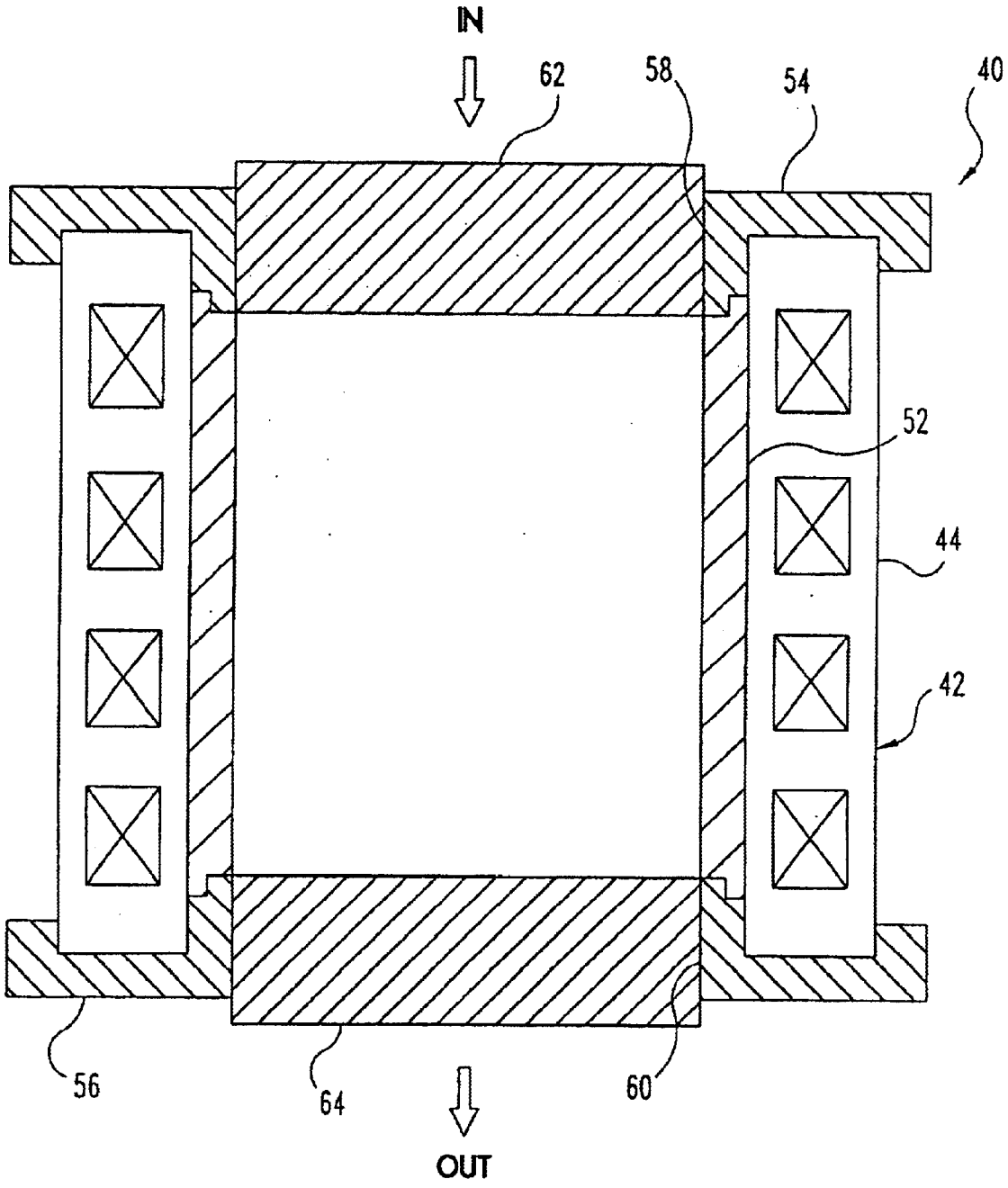
FIG. 3 is a diagrammatic, front elevational view of a vessel and stator arrangement for producing a semi-solid billet of material according to the present a invention.

The FIG. 3 embodiment is based upon the structure illustrated in FIG. 2 and provides additional details regarding the electromagnetic stirring mechanism 40. Included as part of mechanism 40 is a barrel 52, end plates 54 and 56 having respective inlet and outlet openings 58 and 60, and a pair of plugs 62 and 64. The electro-magnetic stirring mechanism 40 uses the electrical load (volts) feedback from the stator 44 to determine the velocity of the semi-solid metal slurry during stirring. Another option is to use the temperature measurement (see FIG. 2B) from the thermocouple to control the stirring rate. The non-contact stirring mechanism 40 is very efficient and offers simple control over flow rate. In addition, maintenance requirements for the mechanism are minimal. The size of the mold and of the stator are dependent on the total shot weight of the part being produced.

With continued reference to FIG. 2B, the illustrated embodiment is based upon the structure diagrammatically illustrated in FIG. 2A. FIG. 2B illustrates one arrangement according to the present invention for generating a semi-solid slurry. Included as part of the FIG. 2B arrangement is vessel 45, stator 47, and a closing cap 53 which receives a cooperating thermocouple 55. An alternative type of thermal sensor can be used in lieu of the thermocouple 55. Clamped around vessel 45 is thermal jacket 63. In this embodiment, the electromagnetic field due to the stator is controlled by the alloy's temperature which is used as a feedback signal in order to achieve vigorous mixing and sufficient shearing. With appropriate cooling and stirring control, the alloy's cooling rate can be controlled robustly in order to meet a wide range of processing requirements with different alloys, shot sizes, cycle time, and delivery temperatures with minimum non-uniformity in microstructure and temperature distribution. As used herein, the term "robustly" is intended to encompass the capability of using the same techniques to process a wide range of alloys for a wide range of parts with the same degree of control and preciseness in the final composition of the slurry and in the finished part.

The use of a closing cap, such as cap 53, in combination with the vessel, such as vessel 45, represents one feature of the present invention and one option for use in the processing of the molten alloy into a slurry billet. The use of a closing cap, such as cap 53, permits a relatively fast rate of stirring of the molten alloy at the time stirring is initiated, which should be as soon as the alloy is poured into the vessel. Due to the viscosity of the molten alloy at this early stage, a relatively fast rate of stirring could allow the alloy to splash out or spit and thus the reason for closing cap 53. Once the molten alloy begins to cool and its viscosity increases, the rate of stirring continues until such time as the stirring rate (i.e., speed) needs to be reduced in order to obtain higher torque due to the viscous nature of the slurry. If the closing cap is not used, then the initial rate or speed of stirring needs to be set at a lower or slower level so that the molten alloy will not splash out or spit. As the molten alloy begins to cool and its viscosity increases, the stirring speed will gradually ramp up to a higher level and then be maintained at this level until the slurry becomes so viscous that added torque is needed to effect stirring and thus the speed is reduced.

EXAMPLE 1

A 15 pound ingot of 356 aluminum was melted in a furnace at increasing increments of 100° F. until the alloy was in a molten state at a temperature of 1220° F. The molten alloy was then poured into a mold or transfer vessel 40 surrounded by an electrical stator (Delco 114521-3 phase) connected to a Danfuss type 3004 variable drive, which controls the voltage/frequency supplied to the stator 44. The higher the voltage/frequency, the higher the shear stress of the molten metal, which has a direct relationship to the grain size of the alpha grain structure. The available voltage was set at up to 210 volts and the actual voltage was recorded throughout the complete cycle of the process by means of a chart recorder. The temperature of the metal while being stirred in the transfer vessel was also measured and recorded with the same chart recorder as the voltage.

The molten aluminum was poured into the transfer vessel 40 and current applied to stator 44. The metal stayed in transfer vessel 42 until the temperature reached 1085° F. as measured by a thermocouple mounted in the top plug 62 of vessel 42, a residence time of approximately 72 seconds. Then, the bottom plug 64 was pulled, allowing the semi-solid metal to exit out from the bottom of the transfer vessel 42. The semi-molten metal is then passed through the pour hole 48 of the die casting machine 28 and injected into the cavity 50 of mold 30.

Figure 4:
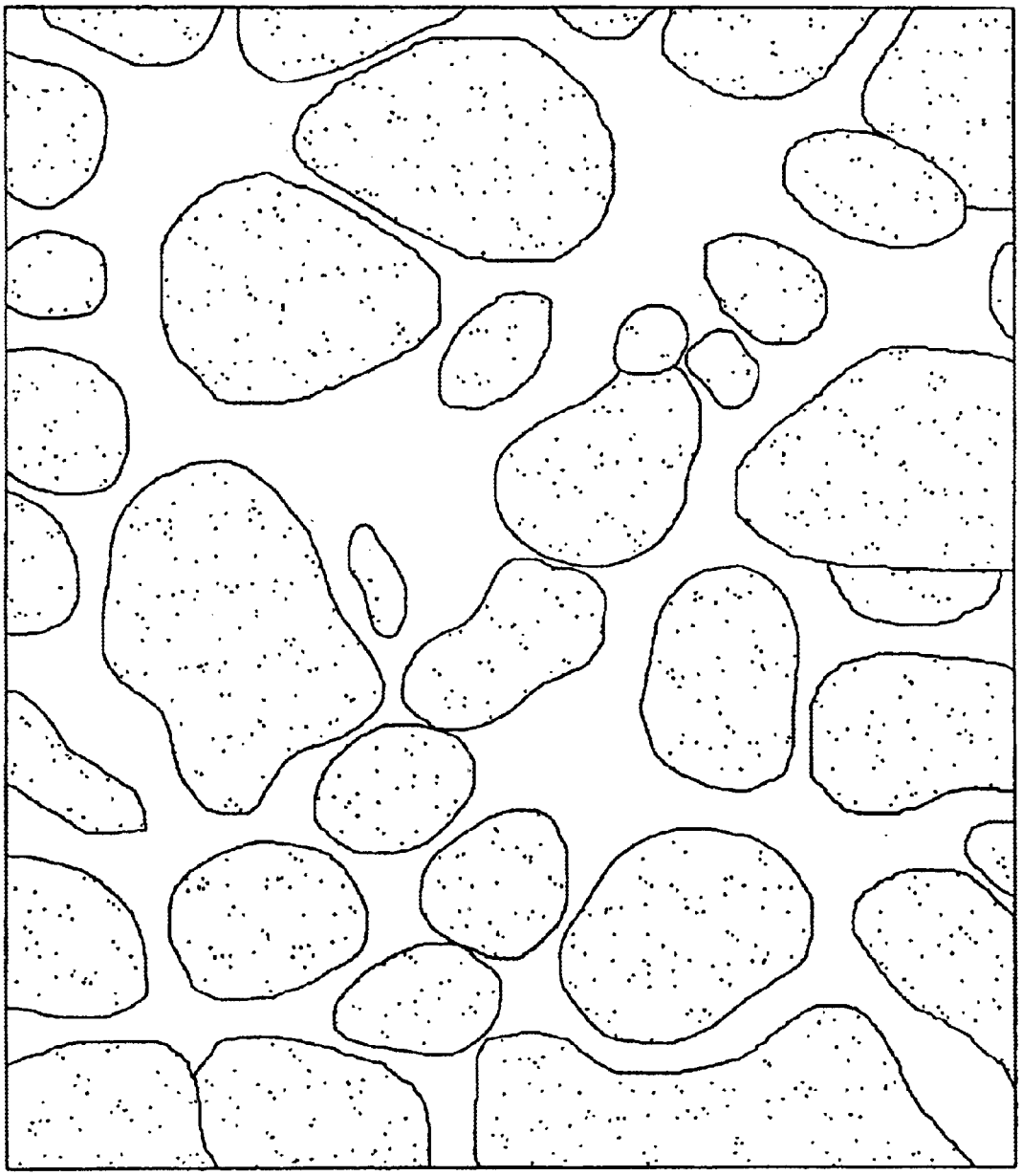
FIG. 4 is a photomicrograph of a globular grain structure at a magnification of 200×.

A sample of the semi-solid metal that exited from the bottom of transfer vessel 42 was cut with a knife to verify its semi-solid state. A sample was polished and the photomicrograph shown in FIG. 4 taken at a magnification of 200× shows the globular grain structure.

The "on-demand" concept for the production of a semi-solid material and the corresponding apparatus according to the present invention provides a number of advantages over prior art arrangements and methods. In order to establish a robust process, it is necessary to have relatively precise cooling rate and temperature control. It is also important to have a method (and corresponding apparatus) for discharging the slurry billet directly into the shot sleeve of the casting machine for direct injection into the die or mold for the desired part of parts. One of the desired characteristics of the present invention is the ability to produce the slurry billet within a comparatively short cycle time so that there is a correspondingly high production rate for the finished parts. If the cooling rate of the alloy is too slow, the time cycle precludes a short cycle time. If the cooling rate of the alloy is too fast, the electromagnetic stirring which is utilized as part of the present invention may not be vigorous enough to achieve the desired alloy microstructure composition. The rate of cooling is also related to the temperature gradient and the blending of lower temperature alloy with higher temperature alloy within the same vessel. Without stirring, the alloy temperature near the surface would be much colder than the alloy in the central region. With stirring of the molten alloy, the heat transfer mechanism includes convection internally and conduction through the vessel wall. Convection at the outer surface of the vessel wall occurs due to forced or natural air flow when a thermal jacket is not used. Without stirring, the heat transfer within the alloy within the vessel is by conduction only and is correspondingly slower. The electromagnetic stirring which is used as part of the present invention creates shear forces in the alloy to modify its microstructure and provides for the blending of different temperature alloy portions.

Figure 5:
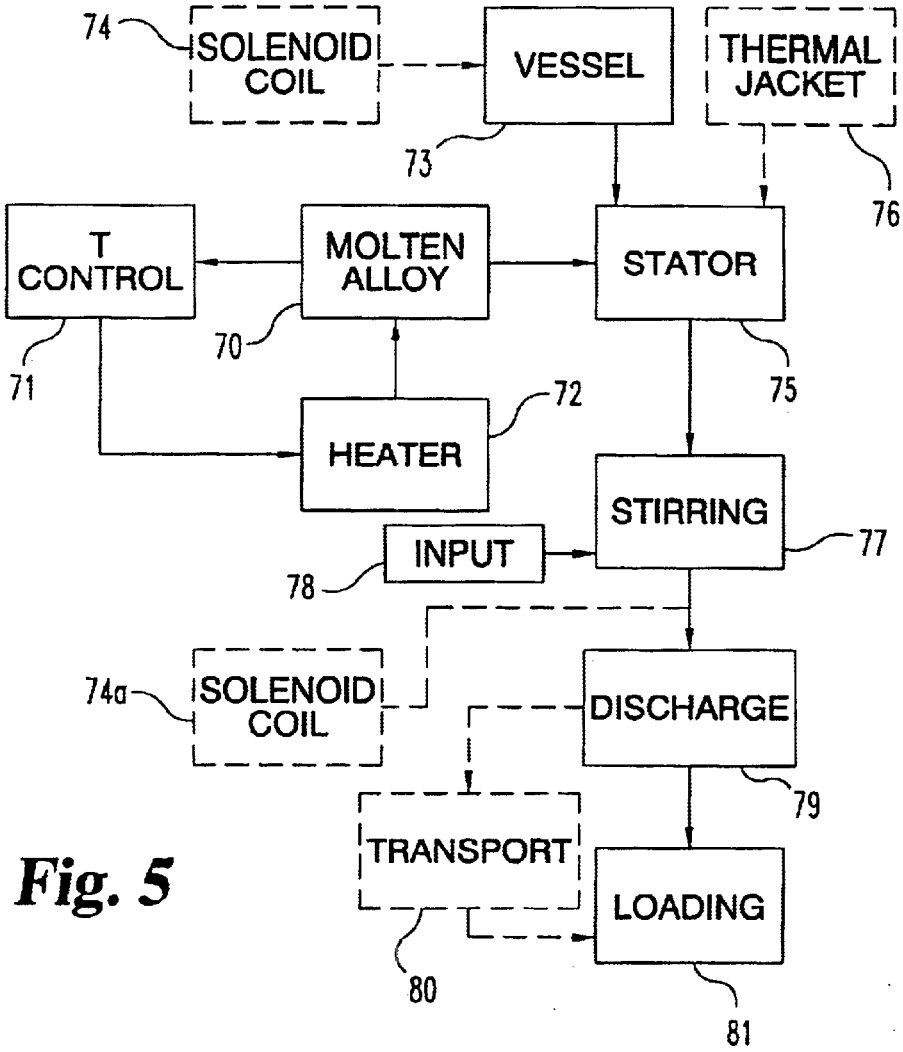
FIG. 5 is a flow chart detailing the various steps and stages of a process for producing a semi-solid material for castings according to the present invention.

With reference to FIG. 5, a flow chart is provided which arranges the primary stages or operations of the present invention and offers some of the design options which are contemplated. At each stage there is a cooperating apparatus which is part of the present invention and which provides certain benefits and improvements over prior art arrangements. At the first stage 70, the selected alloy is heated to a molten state and is maintained at this molten temperature by means of a temperature control circuit 71 and heater 72. In the preferred embodiment, aluminum alloy 357 is used and the molten alloy is maintained at stage 70 within a temperature range of between 630° C. and 700° C. However, the present invention is suitable for handling and processing various alloys.

When there is a demand for a single shot of a semi-solid slurry composition of the aluminum alloy, a volume of the molten alloy is transferred (poured) into a vessel at stage 75 where initial cooling of the alloy begins. As described hereinafter, the vessel 73 may be initially positioned with or in cooperation with a coil 74. Since this is optional, the block for coil 74 has been drawn in broken line form. If a tilt table is used to support and transfer the slurry billet (see FIGS. 7, 8, 10, and 11) to the shot sleeve and a solenoid coil is used for the discharge from the vessel, then coil 74 may be present at the start of the process as indicated in FIG. 5. When a robotic arm is used to transport the vessel (see FIG. 2B), there is no need for any tilt table or stand. The robotic arm is used to ladle the molten alloy into the vessel, to move the vessel into the stator, and to move the vessel from the stator into the coil for using the coil as a discharge mechanism. In this case, coil 74 is used later in the cycle and is denoted at a second location by broken line block 74*a* in FIG. 5. The stator at stage 75 may be used in cooperation with a thermal jacket 76. If the thermal jacket 76 is used, it is clamped around the vessel before the molten alloy is poured into the vessel. Electromagnetic stirring is used as part of the method and apparatus of the present invention (stage 77), and stirring begins as soon as the molten alloy is poured into the vessel. As described in connection with various embodiments of the present invention, the vessel which receives the molten alloy may be placed within a thermal jacket before the molten alloy is poured into the vessel. If used, the thermal jacket is surrounded at this point by the stators or stator which effect electromagnetic stirring at stage 77. Alternatively, if the thermal jacket 76 is not used, the vessel 73 may be positioned within the stator arrangement prior to the time that the molten alloy is poured into the vessel. Since cooling of the vessel is necessary, with or without the jacket, natural air cooling or forced air cooling may be used. It is important that the vessel have an elevated temperature either from the latent heat in the previous cycle or from the heating element in the thermal jacket before the molten alloy is added so as to reduce any thermal shock. Block 78 represents the energizing power input to the stator or stators.

With regard to the "cycle time" for producing a slurry billet for use directly into a shot sleeve of a die casting machine or other molding or casting device, the cycle begins when a volume of molten alloy is removed from the holding vat or furnace and poured into the vessel. By first placing the vessel within the stator, with or without a thermal jacket, the stator can be energized as soon as the molten alloy is placed in the vessel, thereby reducing or minimizing any time delays. This arrangement and method allows cooling and stirring to begin at once and concurrently which contributes to the relatively shorter cycle time of the present invention.

The mechanisms used for the transferring or pouring step of the molten alloy into the vessel (stage 70 to stage 75) include the use of a ladle which can be manually handled or which can be manipulated by a robotic arm. The volumetric control for the single shot of molten alloy is achieved by the sizing of the ladle, though the precise volume is not critical so long as sufficient material is provided for the part or parts to be cast. Regardless of the means selected for drawing out a volume of molten alloy, the time to ladle out the alloy and transfer it into the cooling vessel at stage 75 is only a few seconds, typically between four and six seconds, regardless of the specific alloy.

As the molten alloy is poured in the vessel, the cooling of the alloy begins. The rate of cooling depends in part on the design of the vessel, including its size, shape, and material. The vessel wall can be configured with internal cooling lines and/or an external cooling flow of air or similar fluid in order to reduce the temperature of the vessel by forced convention. The cooling by convection can be natural or forced. Another cooling option is to use a thermal jacket. Another consideration for the design of the vessel relates to how the slurry billet (once produced) will be discharged from the vessel into the shot sleeve or similar receptacle for use in the casting (or molding) process. Stages 79, 80, and 81 depict the discharge and loading steps.

EXAMPLE 2

Consistent with the teachings of the present invention and with continued to reference to the steps of the FIG. 5 flow chart, an engine-suspension bracket was fabricated. The original design of this bracket used cast iron and there was an interest in reducing its weight for improved fuel efficiency for the vehicle. A decision was made by the auto maker to use an aluminum alloy for the bracket. However, the aluminum bracket made with conventional high-pressure die casting failed to pass the evaluation because of its low elongation, which could lead to a catastrophic failure in a collision. When the apparatus and process steps of the present invention were used for the fabrication of this bracket, it was determined that all of the desired material properties for the bracket could be achieved. The specifics of the actual process used for the fabrication of this engine-suspension bracket, according to the present invention, are outlined below.

Al 357 is melted into a molten state in a furnace at 650° C. A back-fill automatic ladle with melt-level sensors is used to lift 12 pounds of molten melt from the furnace and pour it into a two-piece graphite crucible, which has an inside diameter of approximately 3.5 inches, an outside diameter of approximately 5.0 inches, and a height or depth of approximately 14 inches. The crucible is mounted on a robot arm with suitable control circuitry controlling that robot arm for movement of the crucible. Before the molten melt is poured, the crucible is positioned coaxially inside a two pole three-phase rotary stator. Atmospheric air is forced through a gap between the stator and crucible with an air blower. After the molten melt is poured into the crucible, the stator is actuated with an initial current of 25 amps in order to stir the molten metal without spilling. As the molten metal's temperature decreases, the current increases by approximately 10 amps every 3 seconds. When the current level reaches approximately 100 amps, it is kept constant at that level. This level of current is determined so that the microstructure of the semi-solid billets become degenerated dendritic. The total stirring/cooling time of the metal in the crucible is approximately 35 seconds. The residence time is determined so that the billet's temperature will be approximately 602° C. Then, at this point, the robot arm moves the crucible to the shot sleeve of a 900-ton horizontal die-casting press, all within approximately 5 seconds. At that time, the crucible opens in order to drop the semi-solid billet into the shot sleeve and the plunger is actuated immediately in order to inject the metal into the die at a ram speed of approximately 15 inches per second. After the cavity is completely filled, a high pressure of approximately 17 ksi is applied on the remaining metal in the shot sleeve for approximately 15 seconds so that, as the metal in the die shrinks due to solidification, additional metal is squeezed into the die cavity in order to compensate the volume and to suppress the formation of porosity in the finished part. After that, the die opens in order to eject the part which drops into a water tank immediately below, after which any further machining or fabrication steps are performed, such as cutting off any die runner. The as-cast part is then heat treated in order to increase the mechanical properties.

Figure 6:
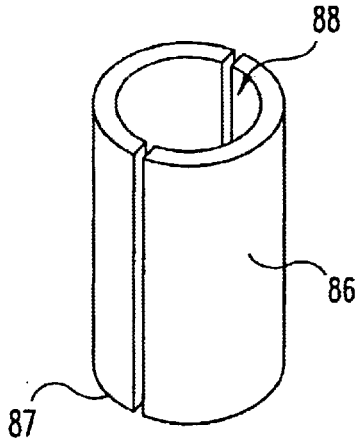
FIG. 6 is a perspective view of one vessel design for use as part of the FIG. 5 process and cooperating apparatus.

Suitable materials for the vessel, which is substantially cylindrical, include graphite, ceramics, and stainless steel. Some of the important material properties for the vessel include its strength, its corrosion resistance, having good thermal conductivity, and good electromagnetic penetration. The typical size ranges for the vessel include lengths from one inch to thirty-five inches and outside diameters from one inch to twelve inches. The preferred length to "width" aspect ratio is between 1.2:1 and 4:1. The inside surface of the vessel may be coated with a suitable material such as boron nitride or other corrosion resistant material which protects the vessel and may actually help the slurry billet discharge from the vessel. There is a design correlation between the preferred materials for the vessel relative to the possible discharge apparatus to be used and to the alloy composition being processed. There is also a design correlation between the vessel material, discharge apparatus, the specific alloy, and whether the inside surface of the vessel is coated and, if coated, with what material. As for the discharge apparata and methods, one embodiment of the present invention includes the use of a two-part vessel 86, split lengthwise so as to open like a clamshell. The design includes a bottom wall 87 and an open top 88 as illustrated in FIG. 6.

Another vessel design according to the present invention includes the replacement of the bottom wall with a piston or plunger mechanism to actually push the slurry billet completely out of the vessel. In this arrangement, the plunger of the hydraulic or pneumatic cylinder needs to have a stroke so as to extend completely through the vessel in order for a complete discharge. A further discharge technique of the present invention which influences the design of the vessel includes the use of a solenoid coil and a robotic arm or a tilt-table mechanism. The coil actually melts a thin layer of alloy which is in contact with the vessel side wall and actually squeezes the slurry so as to force it out of contact with the vessel wall. The vessel which is either secured to a support table which may tilted, or which is held by a robotic arm which may be rotated, is turned so that gravity can act on the slurry billet and actually pull it out of the vessel. Whether by a tilt table arrangement, a rotary indexing table, a conveyor, or by a robotic arm, the vessel needs to be moved into position above the shot sleeve so when the vessel is tilted and the slurry billet slides out, it drops directly into the shot sleeve of the die casting machine and is, at that moment, ready for the die casting process to begin.

A still further slurry billet discharge technique is to use a DC coil placed at the closed end of the vessel. Cooperating with this arrangement is a robotic arm which is constructed and arranged to be able to tilt the vessel so that the slurry billet can come out and be deposited in the shot sleeve of the corresponding die casting machine. In the arrangement where a DC coil is used, the vessel and coil are first tilted and then an energizing pulse to the coil is used to create a force spike that actually pushes the slurry billet out of the vessel with the assistance of gravity.

Additional design details regarding the type of vessel which is suitable for use as part of the present invention are disclosed in the copending patent application, Ser. No. 09/585,296, filed on Jun. 1, 2000, by inventors Norville, Lombard, and Wang and assigned attorney docket number 9105–4. This co-pending patent application is hereby expressly incorporated by reference for its entire disclosure. This incorporated patent application discloses various vessel designs as well as various slurry billet discharge methods and apparata, all of which are incorporated by reference and are considered to be part of the present invention.

When the slurry billet is discharged from the vessel, regardless of the particular technique employed and regardless of the vessel design, it is important to load the slurry billet into the shot sleeve of the die casting machine promptly. The time to discharge the slurry billet and position it in the shot sleeve and the cooling which occurs during this time interval must be factored into the desired composition of the slurry billet at the time of discharge and the desired composition of the slurry billet at the start of the die casting process.

One option for transport of the slurry billet from the vessel into the shot sleeve is to simply position the vessel above the shot sleeve and let the slurry billet exit from the vessel as it drops directly into the shot sleeve. This positioning step is preferably performed by the use of a robotic arm in a continuous path and with a continuous motion from the general location of the stator to the general location of the die casting machine and, in particular, directly above the shot sleeve. Another option is to pick and place the vessel on a turntable or conveyor and then lift it off at the shot sleeve location in order to empty or discharge the slurry billet from the vessel directly into the shot sleeve. Here again, robotic arms are used to place the vessel on the turntable (or conveyor) and then lift it off for discharge of the slurry billet once the vessel reaches the general location of the die casting machine. A still further option is to transfer the billet onto a slug carrier and transfer it into the shot sleeve. As indicated, the time to perform this transporting step and the rate of cooling that occurs during the elapsed time interval needs to be factored into the starting and ending slurry billet compositions.

The preferred time interval for slurry billet discharge from the vessel and the subsequent initiation of the injecting step is approximately between 0.1 and 10 seconds, thereby further contributing to the comparatively short cycle time of the present invention. During this relatively brief time interval, any cooling of the slurry billet that might occur is relatively insignificant with regard to the metallurgical composition of the slurry billet, thereby ensuring that the desired metallurgical composition for the purposes of die casting are maintained.

With regard to the cooling rate control and temperature control of the vessel and of the alloy within the vessel, it is important to start the electromagnetic stirring step as soon as the molten alloy is placed in the vessel, all directed to achieving a comparatively short overall cycle time for producing a slurry billet for a subsequent die casting step. Accordingly, it is important to continue the cooling rate control and temperature control during the electromagnetic stirring step in order to achieve the desired slurry composition for the billet as quickly as possible, within reason, and taking into consideration metallurgical realities, in order to achieve a comparatively short cycle time.

The cooling rate or time of the alloy at stage 75, and also at the electromagnetic stirring stage 77, depends on the vessel design, the starting temperature of the vessel, the initial temperature of the molten alloy which is ladled into the vessel, and whether any auxiliary cooling is provided. Such cooling can be provided by either internal cooling tubes or conduits in the sidewall of the vessel or by external cooling. External cooling techniques include providing a flow of cooling air along the outside of the vessel. Since this would typically be performed with the vessel positioned within the stator, the cooling air passes between the stator and outside surface of the vessel. Also included is the option of using a thermal jacket which is of a split-half design and constructed and arranged to clamp around the vessel.

Additional design details regarding the type of thermal jacket which is suitable for use as part of the present invention are disclosed in the copending patent application Ser. No. 09/584,859, filed on Jun. 1, 2000, by inventors Lombard and Wang and assigned attorney docket number 9105–5. This copending patent application is hereby expressly incorporated by reference for its entire disclosure.

The vessel design, according to the present invention, takes into consideration the thickness of the sidewall, the density of the material used for the vessel, and the thermal conductivity of that material. It has been learned as part of the present invention that because of the short cycle time which is desired, the cooling rate of the alloy is affected most by the vessel's density, thickness, thermal conductivity, and initial temperature. The vessel needs to have sufficient thermal capacity (weight times specific heat) in order to absorb heat from the metal and good thermal conductivity to dissipate heat quickly to the environment. Based on test results, it has been learned that the alloy's cooling rate can be effectively controlled with the vessel's initial temperature. With the use of a thermal jacket, the initial temperature of the vessel at the start of the cycle when the molten alloy is poured into the vessel and when the electromagnetic stirring begins can be accurately controlled within the desired range.

Figure 10:
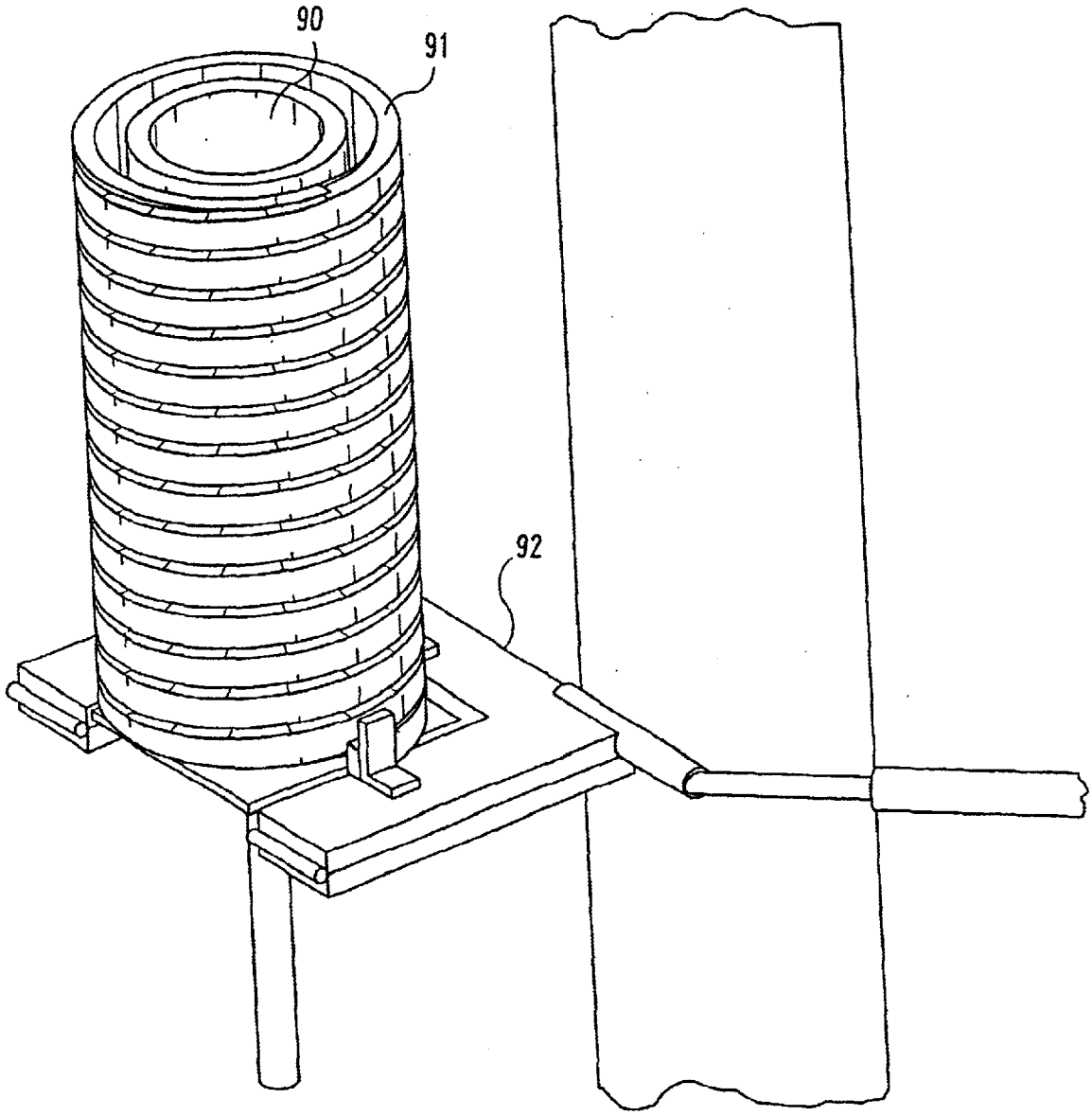
FIG. 10 is a perspective view of the FIG. 7 vessel and solenoid coil after a slurry billet has been produced within the vessel.
Figure 11:
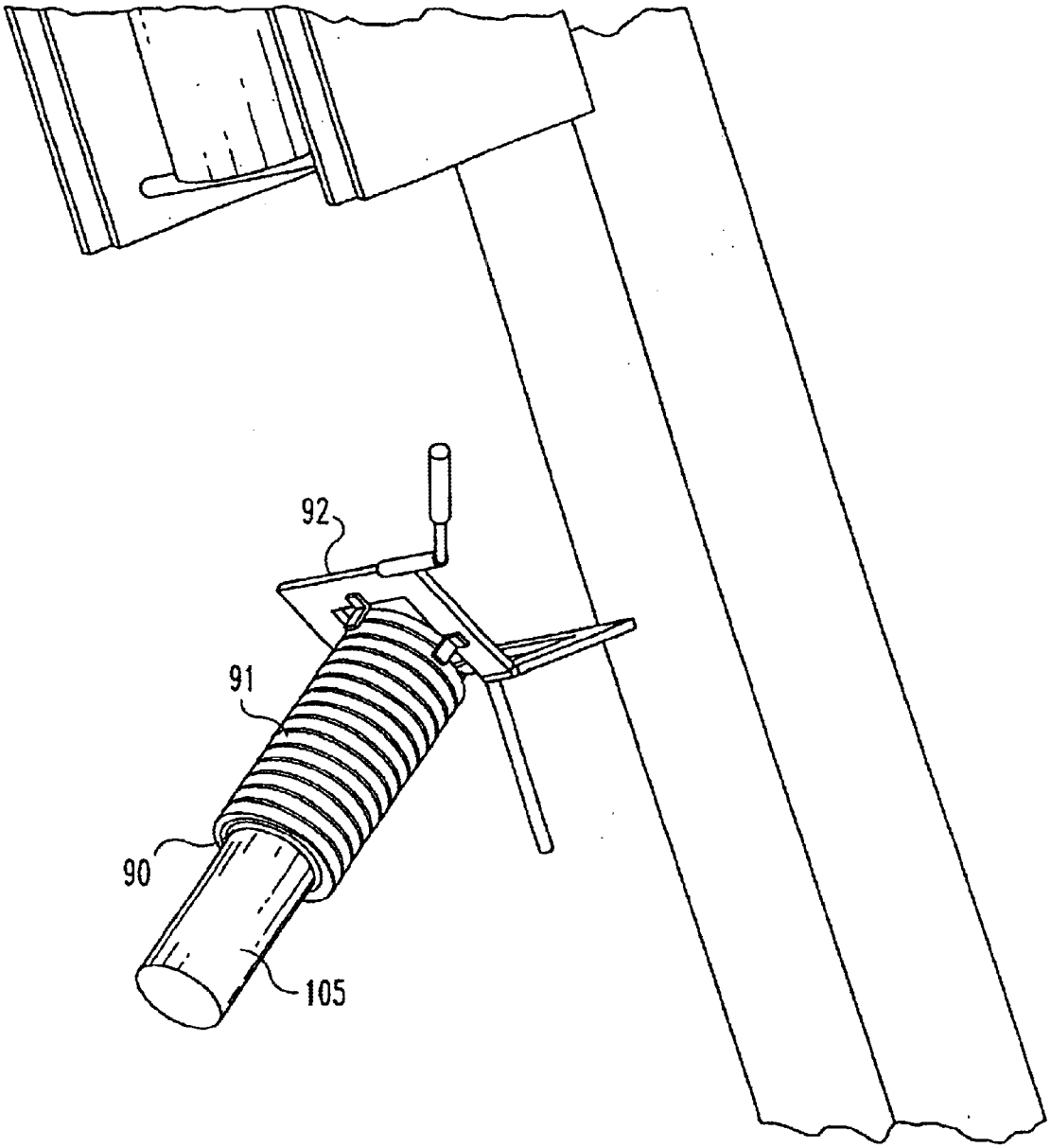
FIG. 11 is a perspective view of the FIG. 10 vessel and solenoid coil being tilted for discharge of the slurry billet.
Figure 12:
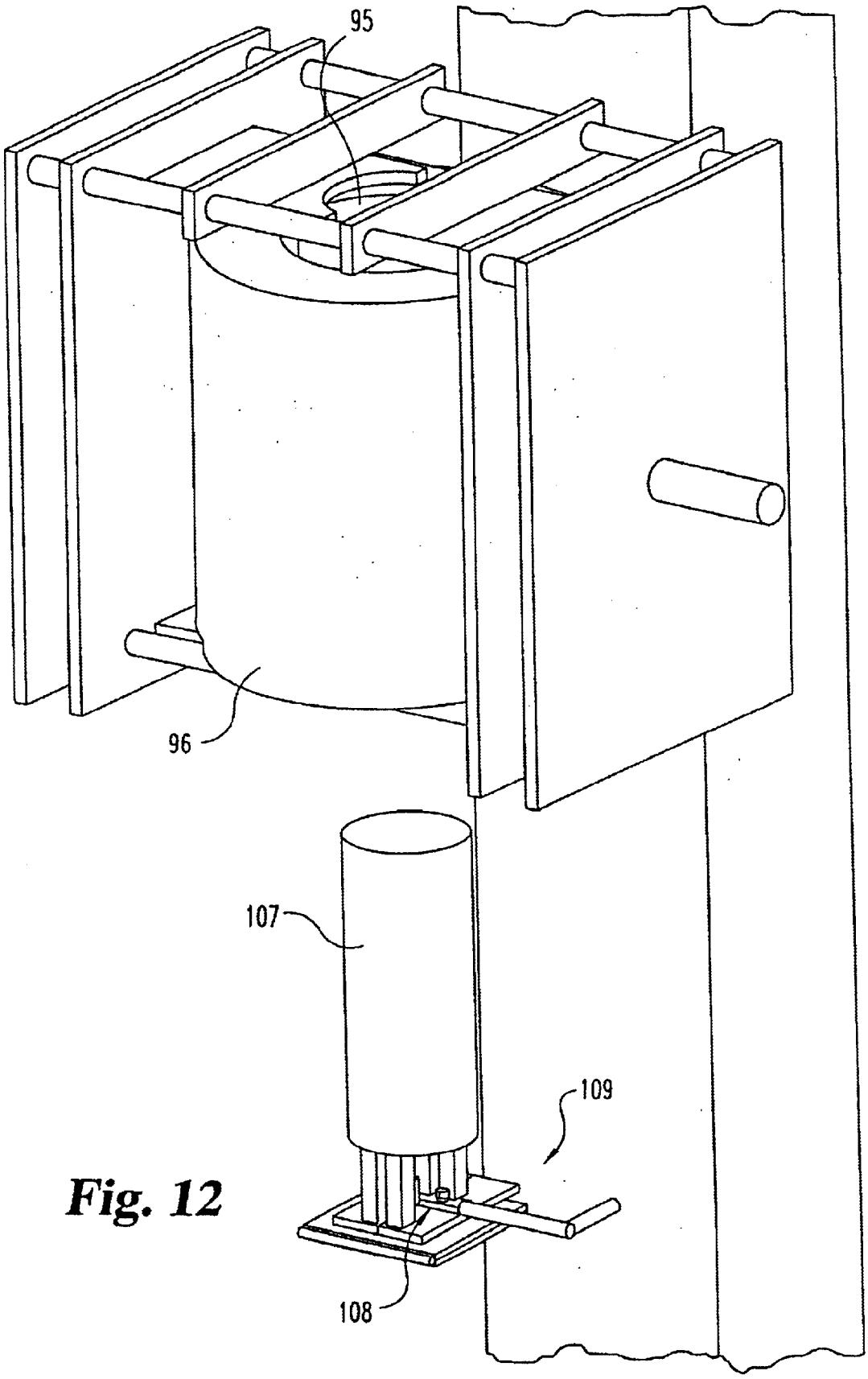
FIG. 12 is a perspective view of a two-piece vessel, stator, and thermal jacket according to another embodiment of the present invention.
Figure 13:
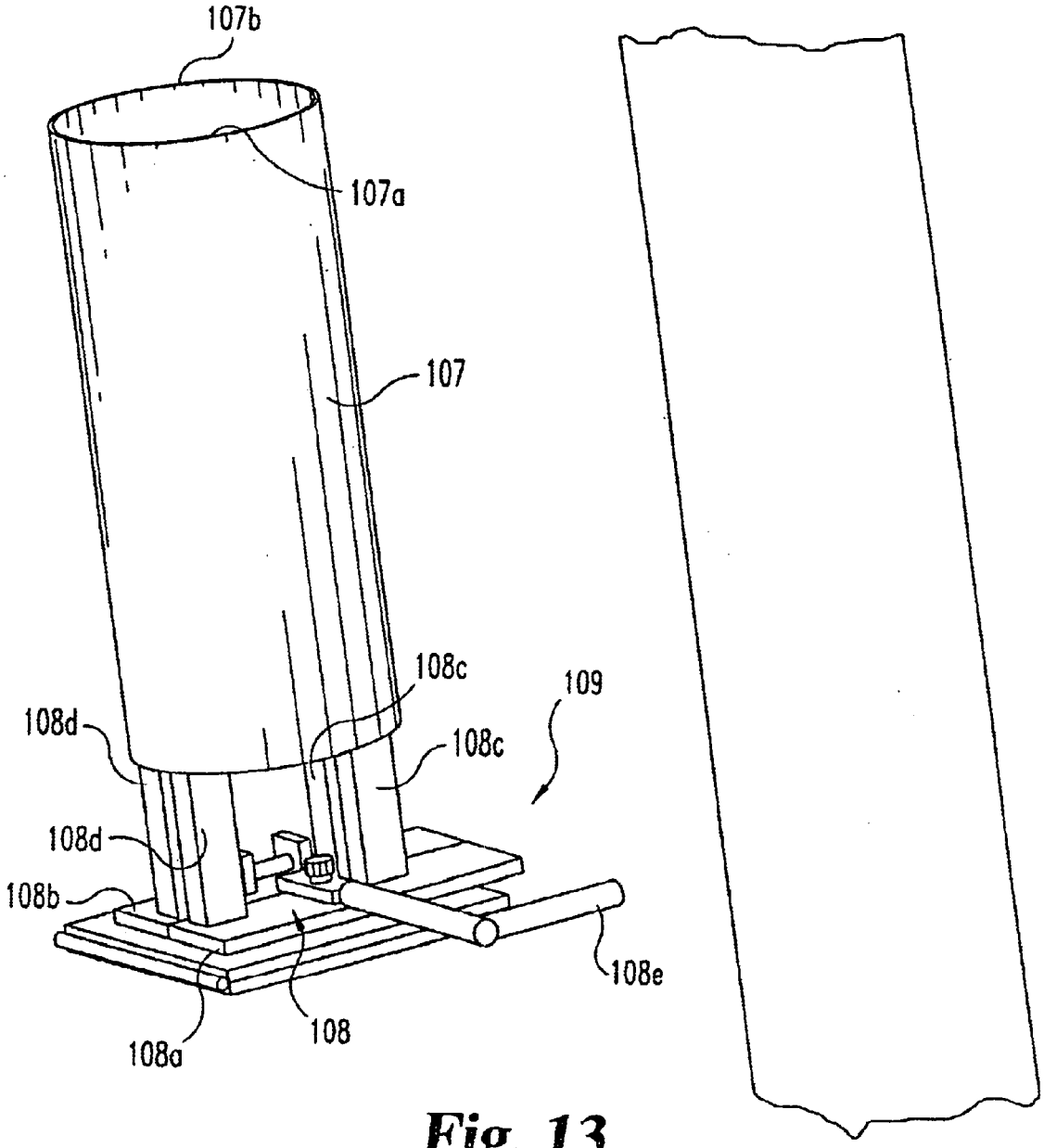
FIG. 13 is a perspective view of the FIG. 12 two-piece vessel after a slurry billet has been produced within the vessel.
Figure 14:
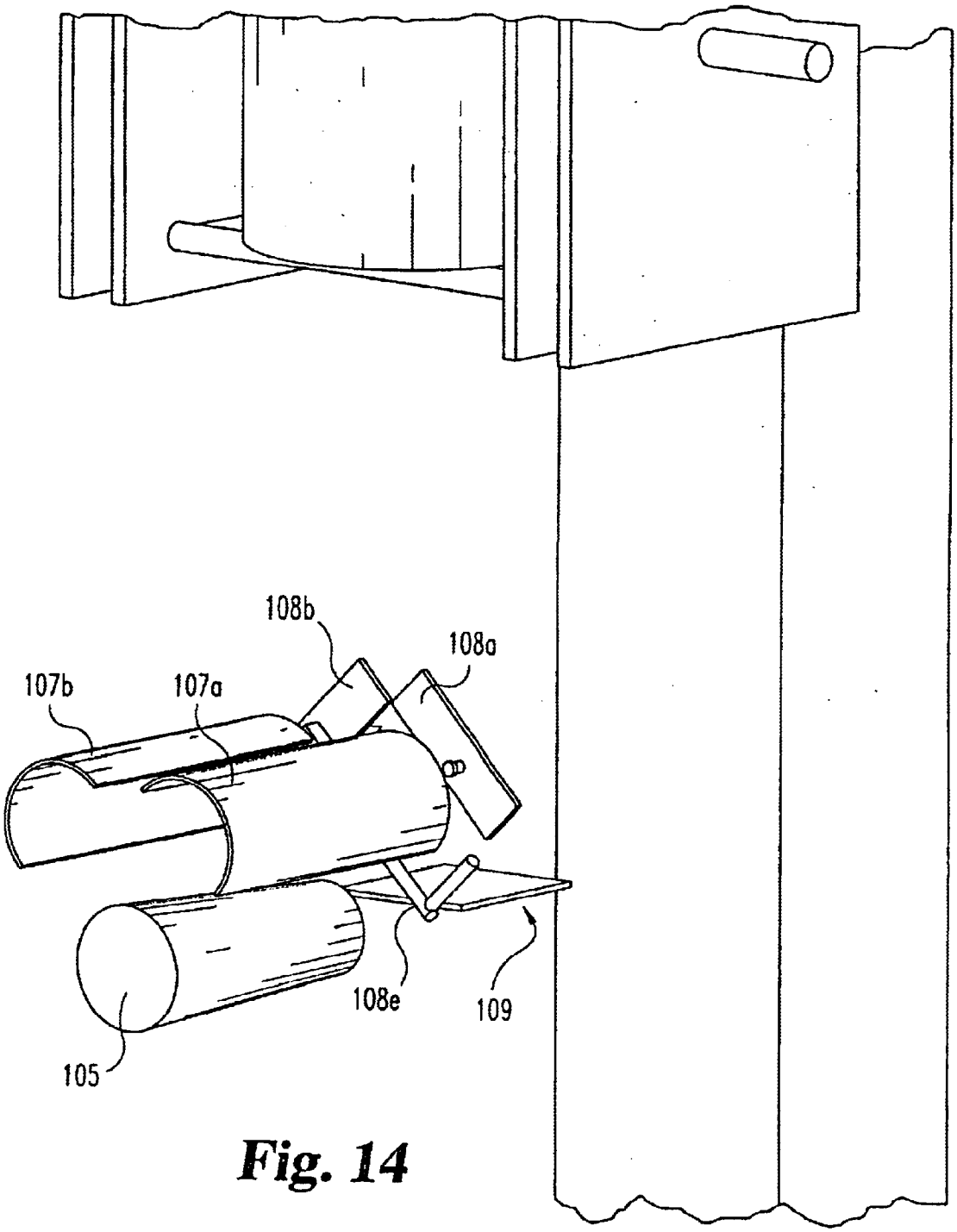
FIG. 14 is a perspective view of the FIG. 13 arrangement showing the opening of the two-piece vessel and the discharge of the slurry billet.

With reference to FIGS. 7–14, some of the processing steps and corresponding apparata of the present invention are illustrated. FIGS. 7–11 illustrate the use of a one-piece vessel. FIGS. 12–14 depict the use of a two-piece vessel. While there are other variations and options as described herein, FIGS. 7–14 provide the disclosure of preferred embodiments of the present invention, depending on the selected style of vessel.

Figure 7:
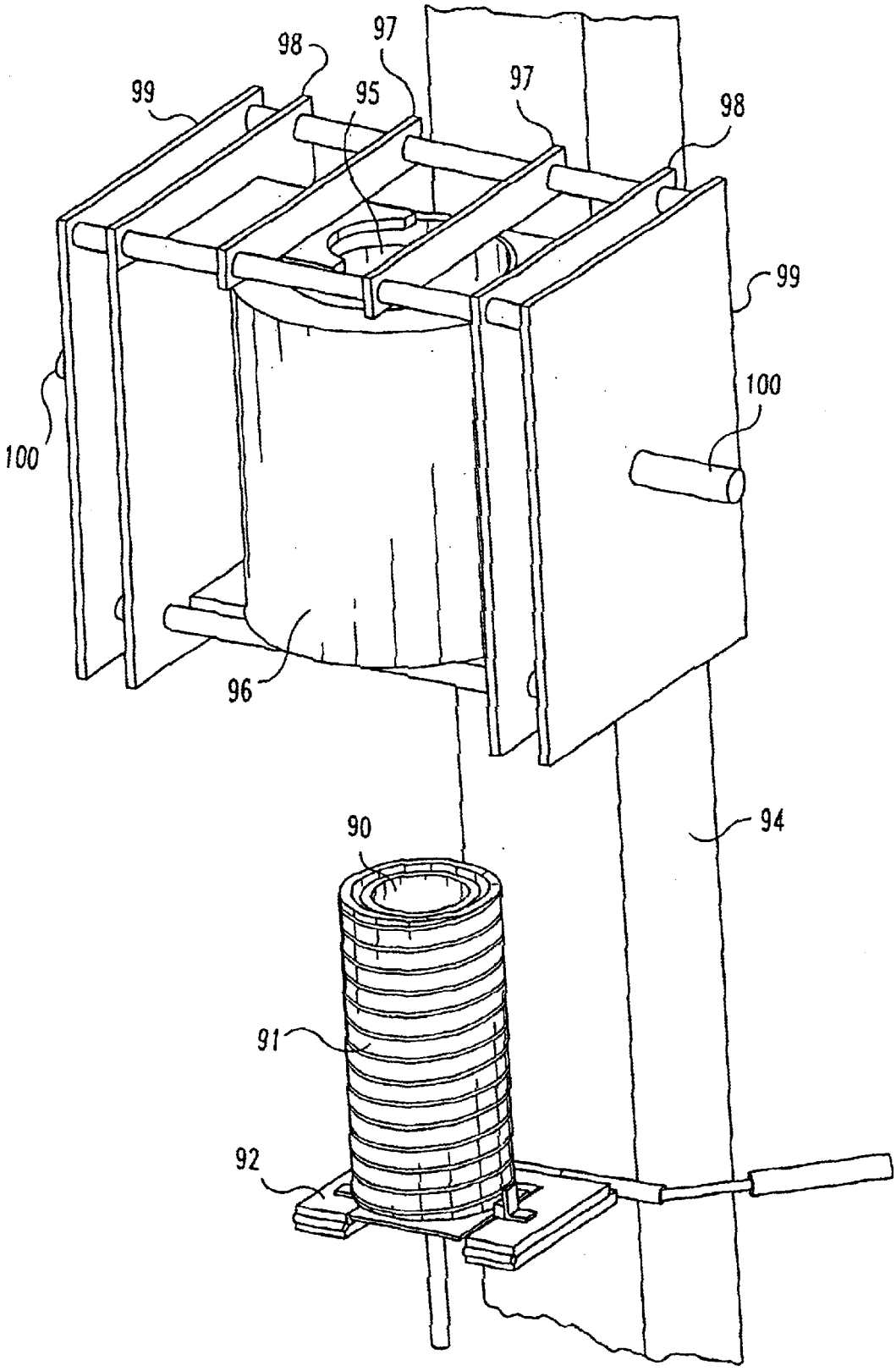
FIG. 7 is a perspective view of a support structure for a vessel, solenoid coil, stator, and thermal jacket according to one embodiment of the present invention.

With reference to FIG. 7, a one-piece vessel 90 is positioned within a solenoid coil 91 and this combination is positioned on a supporting and tiltable table 92. By means of a supporting structure 94, a thermal jacket 95 of a split-half design is positioned within a stator 96. A pair of moving plates 97 in cooperation with connecting plates 98 enable the two halves of the thermal jacket to separate while still within the stator. The outer supporting plates 99 remain stationary and provide support for pneumatic cylinders 100 (one on each side) which operates to open and close the two-piece thermal jacket within stator 96. In using this arrangement, the first step is to move the empty vessel up into the stator by means of a pneumatic cylinder (not illustrated). The coil 91 does not move with the vessel 90. When a thermal jacket is present, a component which has been indicated as an option depending on the selected embodiment of the present invention, the one-piece vessel actually moves up into the thermal jacket.

Figure 8:
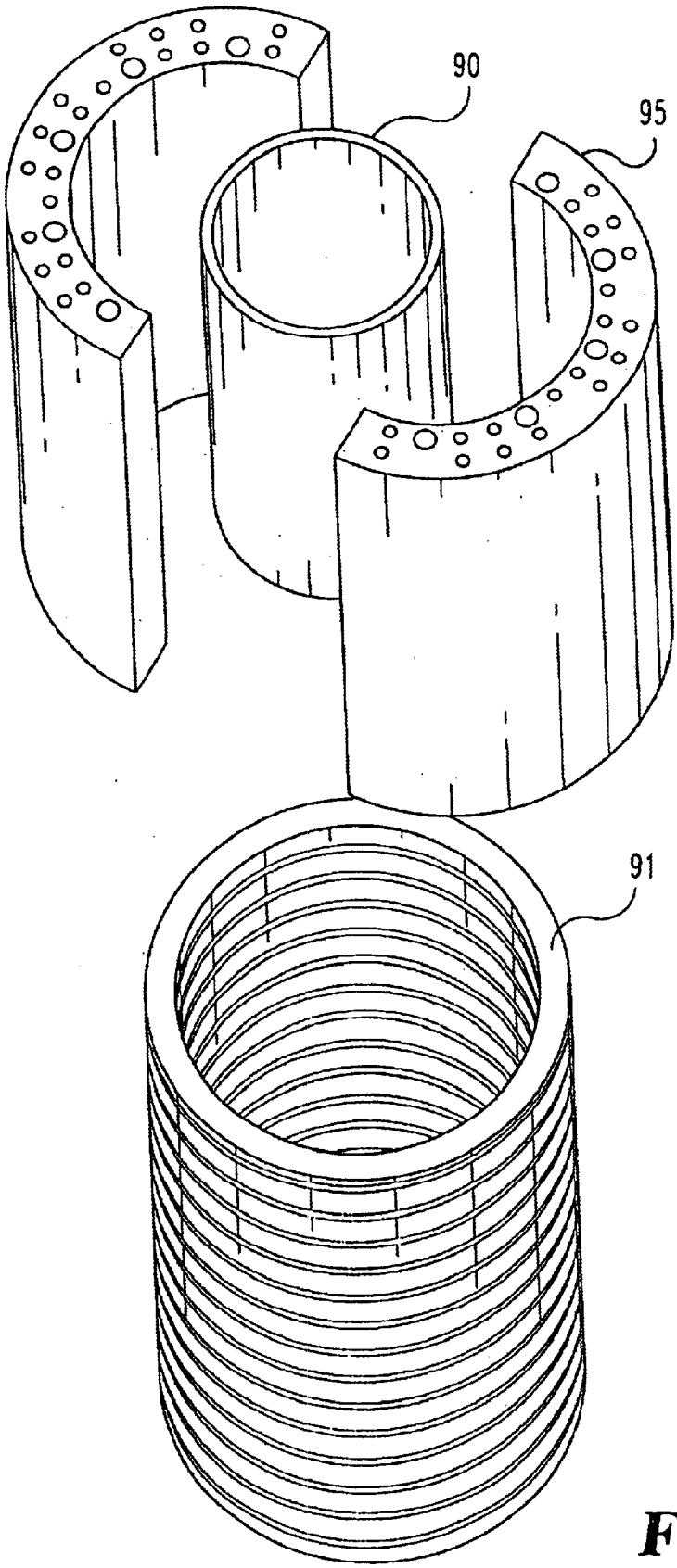
FIG. 8 is a perspective, exploded view showing the movement of the vessel from the solenoid coil into the thermal jacket according to the present invention.

With reference to FIG. 8, the separation of the thermal jacket 95 is illustrated. In this exploded view, the vessel 90 has been transferred out of coil 91 and up into the center of the thermal jacket and the thermal jacket has been separated. In the FIG. 8 illustration, the various sliding and support plates have not been included so that the separation of the thermal jacket and the positioning of the vessel within the thermal jacket can be more clearly illustrated.

Figure 9:
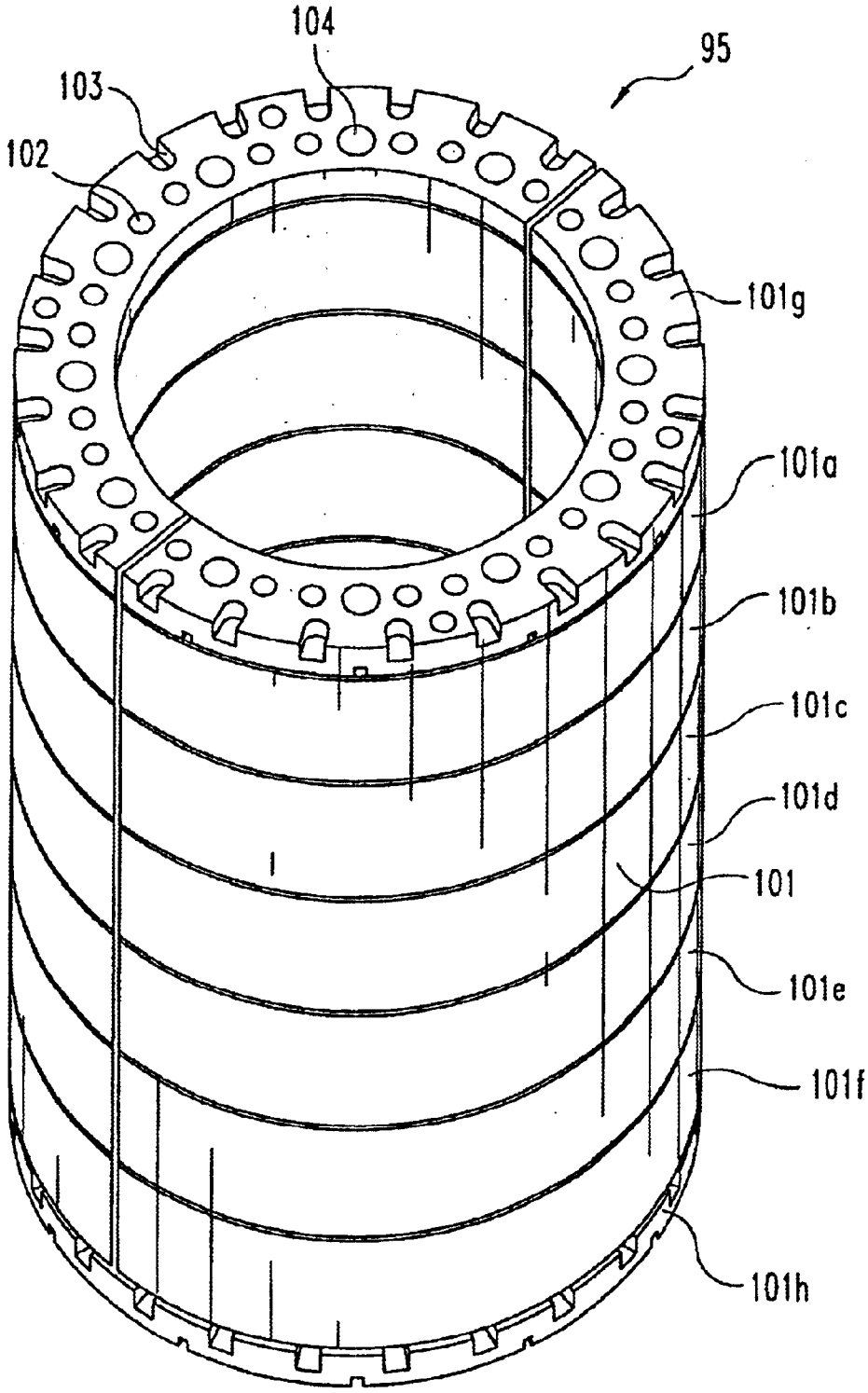
FIG. 9 is a perspective view of the FIG. 7 thermal jacket.

With reference to FIG. 9, one end detail of the thermal jacket 95 is illustrated in greater detail. As can be seen, the sidewall 101 of the thermal jacket 95 includes a plurality of air inlets 102 arranged closer to the inside diameter and a plurality of air outlets 103 arranged closer to the outside diameter surface of the thermal jacket. Also included in the design of thermal jacket 95 is a plurality of cartridge heaters 104. In the preferred embodiment, there are twenty-four air inlets and twenty-four air outlets and twelve cartridge heaters. These features are arranged in a uniform pattern and the two halves of the thermal jacket are substantially identical. The preferred thermal jacket configuration for the present invention includes a plurality of individual axial sections 101*a*–101*f* in addition to upper manifold 101*g* and lower manifold 101*h*. A layer of gasket material is disposed between the manifolds and between each axial section.

The concept behind the cartridge heaters is based upon questions as to whether the flow of cooling air or other fluid through the inlets and outlets can establish the precise thermal jacket temperature which is desired based upon trying to establish an initial vessel temperature. If too much cooling is provided, such that the vessel temperature is out of the desired range or tolerance, the cartridge heaters, which can be more precisely controlled, are used to bring the temperature back into the desired range. An alternative would be to cut back on or cut off the flow of cooling air.

With regard to the illustration of FIG. 10, once the slurry billet has been properly prepared to the desired composition within the thermal jacket 95 and stator 96, noting that the stator is used for electromagnetic stirring while the alloy cools, the vessel 90 returns to its position within coil 91 and this combination remains positioned on table 92 which, as noted, is tiltable. The particular coil design in the FIG. 10 embodiment is an AC coil 91 which performs two primary functions on the slurry billet. First, the power to the coil or the energizing of the coil begins to melt the outer skin of the billet in order to break any bond which it might have with the inside wall of the vessel. The magnetic field which is generated by the AC coil also generates a radial body force which actually squeezes on the slurry billet to help separate it spatially from the inside surface of the vessel. As this particular procedure continues and as these two process steps are performed, the table 92 is tilted, as illustrated in FIG. 11, in order to allow the force of gravity to help eject or discharge the slurry billet 105 from within the vessel.

With regard to FIGS. 12–14, a similar processing sequence is disclosed, but the difference here is that the vessel 107 is a two-piece design and, as will be described, does not utilize nor require any type of coil for discharge of the slurry billet. As before, the vessel 107 is lifted into the stator 96 and if a thermal jacket 95 is present, the vessel 107 is actually moved up into the center of the thermal jacket, noting that the thermal jacket would be split and then subsequently clamped onto the vessel.

Once the vessel 107 is positioned within the thermal jacket 95 which is surrounded by stator 96, the molten alloy is added to the vessel and, at the point that solidification first begins, the stator is energized so as to effect electromagnetic stirring of the alloy as it cools in order to achieve the desired composition for the slurry billet.

With reference to FIG. 13, it will be noted that after the alloy is cooled to the desired semi-solid state, the clamping force of the thermal jacket is released and this allows the vessel 107 to move down and out of the way of the various supporting and moving plates. In the FIG. 13 illustration, it will be noted that the two-piece vessel has a spring catch and split table arrangement 108, as part of tilt table 109, to keep the vessel 107 closed and to prevent the slurry billet 105 from being dropped by accident. The spring catch and split table arrangement 108 includes a hinged table with two halves 108*a* and 108*b*. Each half supports a pair of upright support members 108*c* and 108*d* which connect to the split halves 107*a* and 107*b* of vessel 107. When the spring catch is released by bar 108*e*, the two halves 108*a* and 108*b* are able to swing open. As disclosed in FIG. 2B, the supporting table can be replaced by a robotic arm. When the slurry billet is ready to be discharged, the vessel 107 is moved into position above the shot sleeve of the die casting machine. Next, the two-piece vessel is tilted and opened (as described) in order to release the slurry billet 105 so that it can drop down into the shot sleeve. (See FIG. 14). Due to the versatility of programming and movement options, the use of a robotic arm is preferred as a way to shorten the cycle time and facilitate the automation of the slurry production process.

With regard to electromagnetic stirring, it is known to use a "rotary" stator arrangement which creates a generally horizontal flow loop for a portion of the alloy within the vessel. It is also known to use a "linear" stator arrangement to create a different flow pattern compared to that generated by a rotary stator. When the vessel is relatively long, a linear stator arrangement creates a longitudinal or axial flow loop which helps to reduce the temperature difference (cold zone to hot zone) between the lower to upper ends of the vessel (and billet). The stirring motion which is imparted to the alloy due to the stator is based on the magnetic field and the phase difference between each pair of N-S poles.

MHD stirring can be achieved by utilizing a two-pole, multi-phase stator arrangement or a multi-pole stator arrangement to generate a magnetomotive stirring force on a liquid metal. In general, a suitable stator arrangement includes a plurality of pairs of electromagnetic coils or windings oriented around a central volume. The windings are sequentially energized by flowing electric current therethrough.

With a three-phase, two-pole stator arrangement there are three pairs of windings with a 120 degree phase difference between the AC currents in each pair. A "rotary" stator arrangement generates a rotating magnetic field in the central volume when the respective pairs of windings are sequentially energized with sinusoidal electric current. In the example provided, there are three pairs of windings oriented circumferentially around a cylindrical mixing volume, although other designs may employ other numbers of windings having other orientations. Typically, the windings or coils are electrically connected in order to form a phase spread over the stirring volume.

In use, the magnetic field varies with the change in current flowing through each pair of windings. As the magnetic field varies, a current is induced in a liquid electrical conductor occupying the stirring volume. This induced electric current generates a magnetic field of its own. The interaction of the magnetic fields generates a stirring force acting on the liquid electrical conductor, urging it to flow. As the magnetic field rotates, the circumferential magnetomotive force drives the liquid metal conductor to circulate. It should be noted that the magnetic field produced by a two-pole system has an instantaneous cross section bisected by a line of substantially zero magnetic force while the magnetic field produced by a four-pole system has a central area characterized by essentially zero magnetic force.

With a "linear" stator arrangement, the windings are positioned longitudinally relative to a cylindrical mixing volume. In this configuration, the changing magnetic field induces circulation of the liquid electrical conductor in a direction parallel to the axis of the cylindrical volume.

Another consideration with electromagnetic stirring is the desire to get vigorous stirring without creating a suction vortex that could draw in oxide inclusions and degrade the quality of the cast composition. With regard to creating shear forces to scrape the solidifying alloy off of the surface of the vessel, a rotary stator arrangement is preferred. A further consideration as the alloy cools and its solid fraction increases is to maintain the flow (stirring) motion of the slurry with high torque (low stirring speed) and high penetration. High penetration requires a lower 1*a* line frequency for the stator.

After considering all of the stator design variables, it was conceived as part of the present invention to use a combination of rotary stators and linear stators. Different from MHD casting, the slurry in this invention is not fully solidified in the crucible. A four-pole stator, which is not applicable in MHD casting, has an advantage over a two-pole stator in stirring the slurry because the magnetic stirring field of a four-pole stator is concentrated in the outer radial portion of the slurry-billet where higher force is required to stir the colder metal. One arrangement of two linear stators and one rotary stator is diagrammatically illustrated in FIG. 15. Rotary stator 115 is positioned around the vessel 116 as illustrated. Positioned axially above and below the rotary stator 115 are linear stators 117 and 118, respectively. Positioned around vessel 116 and radially inwardly of the stators is thermal jacket 119. In lieu of a thermal jacket, a heat sink can be used around the vessel to help in the removal of heat from the alloy. The flow pattern which results from the unique combination and arrangement of stators, as illustrated in FIG. 15, is a spiral flow pattern, as illustrated by arrows 120.

Figure 15:
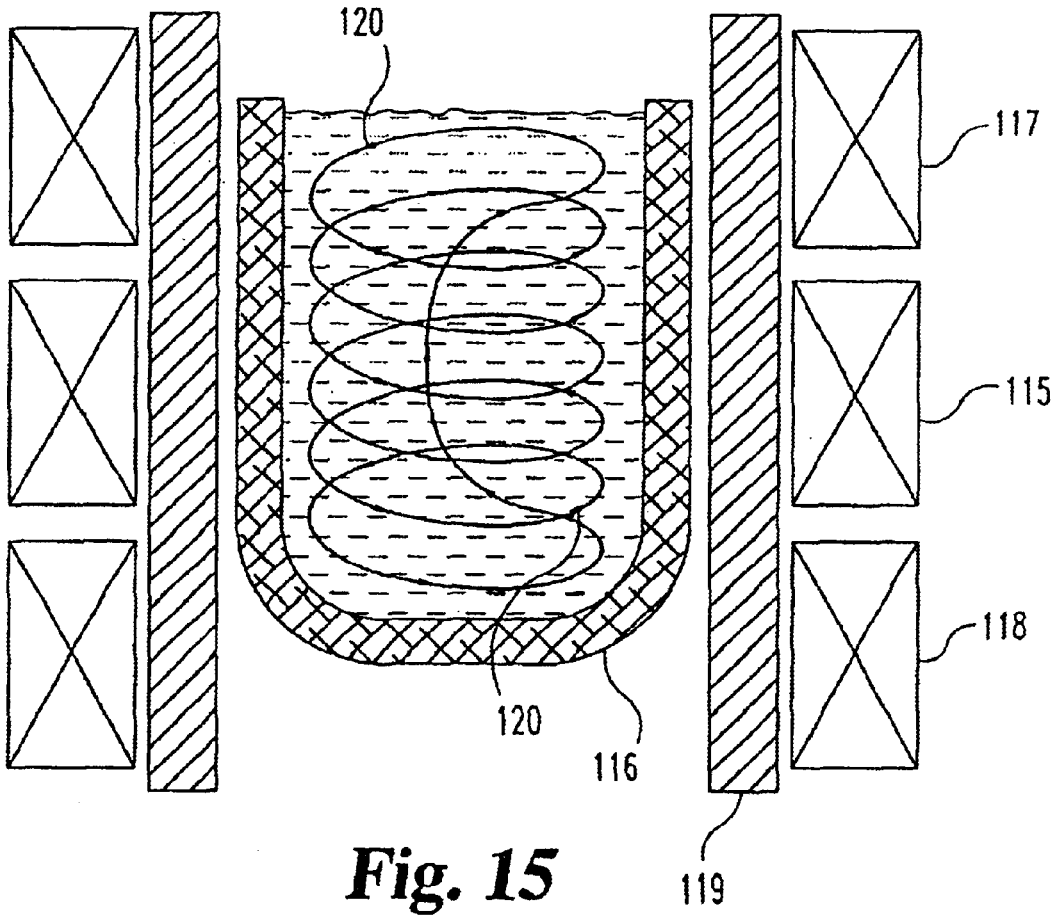
FIG. 15 is a diagrammatic, front elevational view of a vessel and stator arrangement according to the present invention showing the stirring pattern of the alloy within the vessel.

An alternative to the rotary and linear stator arrangement of FIG. 15 is to still alternate the rotary and linear stators, but to start with a rotary stator adjacent the open end of vessel 116. Further alternatives include an alternating series of four stators and an alternating series of five stators. The starting type of stator can be either rotary or linear in each alternative embodiment.

Additional design details regarding the types of stators which are suitable for the present invention, the arrangement of these stators, whether rotary, linear, or both, and the alloy flow patterns which correspond to each stator arrangement according to the present invention are disclosed in the copending patent application Ser. No. 09/585,060, filed on Jun. 1, 2000, by inventors Lu, Wang, and Norville, and assigned attorney docket number 9105–6. This copending patent application is hereby expressly incorporated by reference for its entire disclosure.

Since the focus of the present invention is to create a slurry billet which is discharged directly into the shot sleeve of a casting machine or similar receptacle, all within a comparatively short cycle time, the continued cooling of the alloy during the stirring step remains important. Effective and vigorous stirring combined with temperature controls and cooling rate controls enables a suitable slurry billet to be created at stage 77 with a process step time for the stirring of between five (5) and 120 seconds. The next steps in the process of FIG. 5 include stage 79 where the slurry billet is discharged from the vessel and stage 81 where the slurry billet is directly loaded into the shot sleeve (or other receptacle) of the die casting machine (or other molding station). If there is a transporting step from the discharge step to the loading step, this is represented by block 80. If the vessel (now removed from the stator) is transported (with the slurry billet) to the shot sleeve, the transport block 80 also depicts this step. The style of part to be produced and the number of mold or die cavities influence the predetermined solid fraction percentage which determines the alloy viscosity. When the part geometry is shorter and thicker, a higher alloy viscosity can be accommodated. When the part geometry is long and narrow, a lower viscosity is required so that flow to all ends and portions of the die cavity will occur by laminar flow prior to solidification which may close off or block some portion of the cavity. Similarly, when the part has a relatively simple geometry, a more viscous slurry can be handled by the die casting machine, as compared to a part with greater intricacies and complexities which require a less viscous slurry so that flow to all of the small corners and inclusions within the cavity can be achieved.

The slurry billet discharge techniques, according to the present invention, have been described and additional design aspects have been incorporated by reference. The key is to transfer the slurry billet from the vessel to the shot sleeve in a rapid fashion so that the casting process can be initiated without delay. A prompt transfer to the shot sleeve is also important so that the temperature and viscosity of the alloy does not change appreciably, thereby maintaining the desired alloy properties for the casting step.

The cycle time for producing a suitable slurry billet according to the present invention, starting with the ladling of the molten alloy into the vessel and ending with the loading of the billet into the shot sleeve, ranges from 6.7 seconds, for small slurry volumes of less than ten pounds, to as high as 233 seconds for large slurry volumes of over twenty pounds, depending on the shot size, alloy, and desired viscosity. This comparatively short cycle time is enabled by the cumulative effect contributed by the design of the vessel, the temperature and cooling rate control techniques, the electromagnetic stirring apparatus and method, and the manner of discharging the slurry billet from the vessel directly into the shot sleeve.

The cycle times for the slurry billet processing according to the present invention depend in part on the specific alloy and the required or desired amount of slurry for the part or parts to be die cast in each casting cycle of the die cast machine. As used herein and as used in Table I, a "small" volume of slurry has a range of up to 10 lbs. A "medium" volume of slurry has a range of from 10 up to 20 lbs. A "large" volume of slurry has a range of from 20 to 180 lbs. In Table I, these three volumes or amount ranges are used for aluminum alloy 357. The steps or stages associated with and disclosed by the present invention are listed with the corresponding time ranges for each amount or volume of slurry. These time ranges are achieved by use of the methods and apparata disclosed herein. For a small volume of slurry, the processing time for Al 357, according to the present invention, preferably ranges from 6.7 seconds to 67 seconds. For a medium volume of slurry, the processing time for Al 357, according to the present invention, preferably ranges from 25.7 seconds to 125 seconds. For a large volume of slurry, the processing time for Al 357, according to the present invention, preferably ranges from 60.7 seconds to 233 seconds. As used herein, the concept of a "transferring" step includes both the transporting of the molten alloy from the furnace to the vessel and the pouring of the molten alloy into the vessel. The time range for the pouring step depends in part on the volume of slurry and whether or not the vessel is tilted. One processing option is to tilt the vessel and to pour the molten alloy into the vessel in this orientation and the bringing the vessel to an upright orientation as it fills. This approach takes longer than a more rapid pour directly into an upright vessel. The cumulative effect of the processing steps in Table I is the production of on-demand slurry in a comparatively shorter cycle time than what might be possible with earlier methods and apparata.

TABLE I

| Step | | Slurry Volumes/ Time in Seconds | | |
|---|---|---|---|---|
| | | Small | Medium | Large |
| A Ladle molten alloy into vessel: | Dip* | 1 to 3 | 2 to 6 | 5 to 10 |
| | Transport | 2 to 8 | 2 to 8 | 4 to 12 |
| | Pour | 0.5 to 5 | 0.5 to 10 | 0.5 to 20 |
| B Cooling & stirring of alloy in vessel: | Stir/cool | 2 to 30 | 20 to 70 | 50 to 150 |
| | Unclamp jacket | 0.1 to 3 | 0.1 to 3 | 0.1 to 3 |
| C Transport & discharge of slurry billet: | Move to shot sleeve | 1 to 8 | 1 to 8 | 1 to 8 |
| | Discharge slurry billet | 0.1 to 10 | 0.1 to 20 | 0.1 to 30 |

Notes:
*Clamp jacket onto vessel while molten alloy is being dipped into ladle.
NOTE: There would be some over-lap in the time range between small, medium, and large slurry volumes because there are other parameters affecting the cycle time, e.g., alloy type, delivery temperature, and the vessel's aspect ratio (length to "width").

The method of the present invention for producing on-demand, semi-solid material for a casting process is also envisioned for use in forming a metal matrix composite. In order to do so, the step of adding particulate solid particles into the metal alloy must be performed. Suitable materials for the particulate solid particles include silicon carbide and alumina.

The present invention has been described in the context of preparing a volume of slurry for a shot sleeve. The column of slurry has been put in the context of small, medium, and large amounts with a corresponding weight range. It has also envisioned that a suitable slurry composition can be created in a somewhat continuous manner by way of an integrated slurry maker. The design details regarding this type of apparatus are disclosed in the copending patent application Ser. No. 09/585,502, filed Jun. 1, 2000, by inventors Norville, Wang, and Lombard, and assigned docket number 9105-7.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of producing on-demand, semi-solid material for a casting process, said method comprising the following steps:

heating a metal alloy until it reaches a molten state;

transferring an amount of said metal alloy, while in said molten state, to a vessel;

cooling said amount of metal alloy in said vessel;

applying an electromagnetic field to said amount of metal alloy for creating a flow pattern of said metal alloy within said vessel while said cooling continues in order to create a slurry billet of the desired thixotropic solid to liquid ratio for casting; and discharging said slurry billet from said vessel, directly and immediately, into a shot sleeve of a casting machine, without any intermediate stage of holding said slurry billet between said vessel and said shot sleeve and without any heating step subsequent to said discharging from said vessel.

2. The method of claim 1 wherein the performance of the transferring, cooling, applying, and discharging steps has a total cycle time of between 4 seconds and 250 seconds.

3. The method of claim 2 wherein said transferring step is performed in between approximately 2 seconds and 35 seconds.

4. The method of claim 3 wherein said cooling and said applying steps are performed in a combined time of between approximately 2 seconds and 120 seconds.

5. The method of claim 4 wherein said discharging step is performed in between approximately 0.1 second and 30 seconds.

6. The method of claim 1 wherein said transferring step is performed in between approximately 2 seconds and 35 seconds.

7. The method of claim 1 wherein said cooling and said applying steps are performed in a combined time of between approximately 2 seconds and 150 seconds.

8. The method of claim 1 wherein said discharging step is performed in between approximately 0.1 seconds and 30 seconds.

9. The method of claim 1 wherein said transferring step includes the use of a robotic arm and a cooperating ladle.

10. The method of claim 9 wherein said applying step is performed by moving said vessel into a stator before said transferring step is performed.

11. The method of claim 10 wherein said cooling step is performed by providing a flow of cooling air between said vessel and said stator.

12. The method of claim 10 which further includes the step of clamping a thermal jacket around said vessel, said thermal jacket being positioned within said stator and said clamping step occurring before said transferring step.

13. The method of claim 1 which further includes the step of moving said vessel into a stator before said transferring step is performed.

14. The method of claim 1 wherein said cooling step is performed by providing a flow of cooling air between said vessel and said stator.

15. The method of claim 1 which further includes the step of clamping a thermal jacket around said vessel, said thermal jacket being positioned within said stator and said clamping step occurring before said transferring step.

16. The method of claim 1 wherein said transferring step includes the use of an automatic mechanical ladle.

17. The method of claim 1 wherein said stator is a multi-phase, multiple pole stator causing circumferential flow in the metal alloy.

18. The method of claim 1 wherein said stator is a multi-phase, multiple pole stator causing longitudinal flow in the metal alloy.

19. The method of claim 1 which further includes the step of adding particulate solid particles into the metal alloy for forming a metal matrix composite.

20. A method of producing shaped metal parts from on-demand, semi-solid metal with degenerate dendritic primary solid particles, said method comprising the following steps:

heating a metal until it reaches a molten state;

transferring an amount of said molten metal to a vessel, while controllably cooling said amount of molten metal in said vessel;

applying an electromagnetic field to said amount of molten metal for creating a flow pattern of said molten metal within said vessel until a desired molding temperature within the semi-solid range is reached, thereby creating a slurry billet of the desired thixotropic solid to liquid ratio for casting; and discharging said slurry billet from said vessel, directly and immediately, into a shot sleeve of a casting machine, without any intermediate stage of holding said slurry billet between said vessel and said shot sleeve and without any heating step subsequent to said discharging from said vessel.

21. The method of claim 20 which further includes the step of operating said casting machine in order to cast the slurry billet into the form of a shaped metal part.

22. The method of claim 21 wherein the performance of the transferring, cooling, applying and discharging steps has a total cycle time of between 4 seconds and 250 seconds.

23. A method of producing on-demand, semi-solid material for a casting process, said method comprising the following steps:

heating a metal alloy until it reaches a molten state;

transferring an amount of said metal alloy, while in said molten state, to a vessel;

cooling said amount of metal alloy in said vessel;

applying an electromagnetic field to said amount of metal alloy by the use of a stator for stirring said metal alloy within said vessel while said cooling continues in order to create a slurry billet of the desired thixotropic solid to liquid ratio for casting, a voltage being applied to said stator, the level of said voltage determining the stirring torque applied to said metal alloy;

changing the voltage level applied to said stator so as to change the stirring torque applied to said metal alloy; and discharging said slurry billet from said vessel, directly and immediately, into a shot sleeve of a casting machine, without any intermediate stage of holding said slurry billet between said vessel and said shot sleeve and without any heating step subsequent to said discharging from said vessel.

24. The method of claim 23 wherein said voltage level is changed based upon the sensing of an electric load feedback signal.

25. The method of claim 23 wherein said voltage level is changed based upon the sensing of a temperature measurement signal from said metal alloy.

26. The method of claim 23 which further includes the step of changing the stirring torque applied to said metal alloy based upon the viscosity of said metal alloy in the vessel.

27. A method of producing on-demand, semi-solid material for a casting process, said method comprising the following steps:

heating a metal alloy until it reaches a molten state;

transferring an amount of said metal alloy, while in said molten state, to a vessel;

assembling a covering cap to said vessel in order to permit the use of an inert gas to control contamination;

cooling said amount of metal alloy in said vessel;

applying an electromagnetic field to said amount of metal alloy by the use of a stator for stirring said metal alloy within said vessel while said cooling continues in order to create a slurry billet of the desired thixotropic solid to liquid ratio for casting, a voltage being applied to said stator, the level of said voltage determining the stirring torque applied to said metal alloy; and discharging said slurry billet from said vessel, directly and immediately, into a shot sleeve of a casting machine, without any intermediate stage of holding said slurry billet between said vessel and said shot sleeve and without any heating step subsequent to said discharging from said vessel.

28. The method of claim 27 which further includes the step of inserting a thermocouple through said covering cap and into said metal alloy for deriving temperature information from said metal alloy.

29. A method of producing on-demand, semi-solid material for a casting process, said method comprising the following steps:

heating a metal alloy until it reaches a molten state;

clamping a thermal jacket around an alloy-receiving vessel;

transferring an amount of said metal alloy, while in said molten state, to said vessel;

cooling said amount of metal alloy in said vessel;

applying an electromagnetic field to said amount of metal alloy for creating a flow pattern of said metal alloy within said vessel while said cooling continues in order to create a slurry billet of the desired thixotropic solid to liquid ratio for casting; and discharging said slurry billet from said vessel, directly and immediately, into a shot sleeve of a casting machine, without any intermediate stage of holding said slurry billet between said vessel and said shot sleeve and without any heating step subsequent to said discharging from said vessel.

30. A method of producing on-demand, semi-solid material for a casting process, said method comprising the following steps:

heating a metal alloy until it reaches a molten state;

arranging a plurality of stators around an alloy-receiving vessel, said plurality of stators including at least one rotary stator in combination with at least one linear stator;

transferring an amount of said metal alloy, while in said molten state, to said vessel;

cooling said amount of metal alloy in said vessel;

applying an electromagnetic field to said amount of metal alloy for creating a flow pattern of said metal alloy within said vessel while said cooling continues in order to create a slurry billet of the desired thixotropic solid to liquid ratio for casting; and discharging said slurry billet from said vessel, directly and immediately, into a shot sleeve of a casting machine, without any intermediate stage of holding said slurry billet between said vessel and said shot sleeve and without any heating step subsequent to said discharging from said vessel.

* * * * *

UNITED STATES PATENT AND TRADEMARK OFFICE

CERTIFICATE OF CORRECTION

PATENT NO. : 6,845,809 B1 
APPLICATION NO. : 09/585061
DATED : January 25, 2005
INVENTOR(S) : Samuel M.D. Norville et al.

It is certified that error appears in the above-identified patent and that said Letters Patent is hereby corrected as shown below:

In the Drawings, please amend Fig. 2 by removing "(PRIOR ART)" as set forth below:

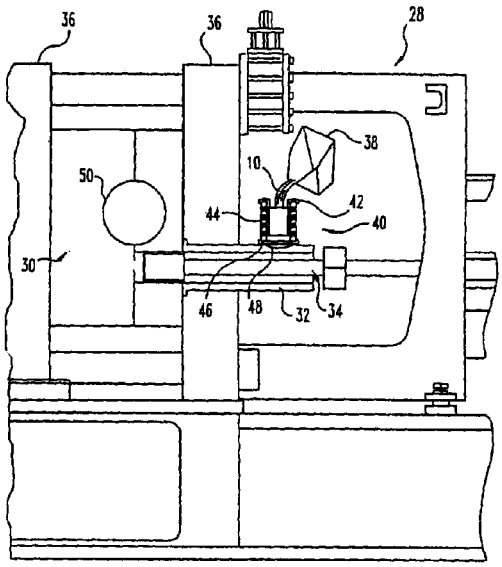

*Fig. 2*

Signed and Sealed this

Third Day of October, 2006

JON W. DUDAS
*Director of the United States Patent and Trademark Office*